US008746028B2

(12) United States Patent
Duggan et al.

(10) Patent No.: US 8,746,028 B2
(45) Date of Patent: Jun. 10, 2014

(54) TUBING EXPANSION

(75) Inventors: Andrew Michael Duggan, Aberdeen (GB); Graeme Thomas Marr, Aberdeenshire (GB); Paul David Metcalfe, Aberdeen (GB); Mark Davies, Aberdeenshire (GB); Neil Andrew Abercrombie Simpson, Aberdeen (GB); Wayne Rudd, Newcastle Upon Tyne (GB)

(73) Assignee: Weatherford/Lamb, Inc., Houston, TX (US)

( * ) Notice: Subject to any disclaimer, the term of this patent is extended or adjusted under 35 U.S.C. 154(b) by 1880 days.

(21) Appl. No.: 10/809,042

(22) Filed: Mar. 25, 2004

(65) Prior Publication Data

US 2005/0005668 A1 Jan. 13, 2005

Related U.S. Application Data

(63) Continuation-in-part of application No. 10/618,419, filed on Jul. 11, 2003, now Pat. No. 7,575,060.

(30) Foreign Application Priority Data

| | | |
|---|---|---|
| Mar. 25, 2003 | (GB) | 0306774.1 |
| May 29, 2003 | (GB) | 0312278.5 |
| Jul. 9, 2003 | (GB) | 0316050.4 |

(51) Int. Cl.
*B21D 3/02* (2006.01)
*E21B 19/16* (2006.01)

(52) U.S. Cl.
USPC ..... 72/119; 166/380

(58) Field of Classification Search
USPC ..... 72/370.01, 370.06, 370.08, 118, 119, 72/370.07; 166/207, 55.8, 380, 384
See application file for complete search history.

(56) References Cited

U.S. PATENT DOCUMENTS

| | | | |
|---|---|---|---|
| 447,582 | A | 3/1891 | Robertson |
| 761,518 | A | 5/1904 | Lykken |

(Continued)

FOREIGN PATENT DOCUMENTS

| | | |
|---|---|---|
| EP | 0 041 835 | 12/1981 |
| EP | 0 952 306 | 10/1999 |

(Continued)

OTHER PUBLICATIONS

A. M. Al-Sharif, Ph.D, and R. Preston, E. Eng., Improvement in UOE Pipe Collapse Resistance by Thermal Aging, Offshore Technology Conference, May 1996, pp. 579-587.

(Continued)

*Primary Examiner* — Debra Sullivan
(74) *Attorney, Agent, or Firm* — Patterson & Sheridan, LLP

(57) ABSTRACT

There is disclosed a tubing expansion device and a method of expanding tubing.
In one embodiment, an expansion device (10) is disclosed which comprises at least one expansion member (14) adapted to expand a tubing (12) by inducing a hoop stress in the tubing (12), and at least one further expansion member (16) adapted to expand the tubing (12) by inducing a compressive yield of the tubing (12); and a method of expanding tubing (12) comprising the steps of expanding the tubing (12) at least in part by inducing a hoop stress in the tubing (12), and expanding the tubing (12) at least in part by inducing a compressive yield of the tubing (12).

70 Claims, 21 Drawing Sheets

(56) References Cited

U.S. PATENT DOCUMENTS

| | | | | |
|---|---|---|---|---|
| 1,324,303 | A | 12/1919 | Carmichael | |
| 1,545,039 | A * | 7/1925 | Deavers | 72/118 |
| 1,561,418 | A | 11/1925 | Duda | |
| 1,569,729 | A | 1/1926 | Duda | |
| 1,596,751 | A | 8/1926 | Millspaugh | |
| 1,597,212 | A | 8/1926 | Spengler | |
| 1,930,825 | A | 10/1933 | Raymond | |
| 2,096,234 | A | 10/1937 | Erwin | |
| 2,375,108 | A | 5/1945 | Hopkins | |
| 2,383,214 | A | 8/1945 | Proul | |
| 2,499,630 | A * | 3/1950 | Clark | 72/113 |
| 2,546,756 | A | 3/1951 | Knowlton | |
| 2,575,938 | A | 11/1951 | Brenneke | |
| 2,627,891 | A | 2/1953 | Clark | |
| 2,683,073 | A | 12/1953 | Bieber et al. | |
| 2,898,971 | A | 9/1959 | Hempel | |
| 3,087,546 | A | 4/1963 | Wooley | |
| 3,167,122 | A | 1/1965 | Lang | |
| 3,179,168 | A | 4/1965 | Vincent | |
| 3,195,646 | A | 7/1965 | Brown | |
| 3,353,599 | A | 11/1967 | Swift | |
| 3,412,565 | A | 11/1968 | Lindsey et al. | |
| 3,467,180 | A | 9/1969 | Pensotti | |
| 3,529,667 | A | 9/1970 | Malone | |
| 3,643,485 | A | 2/1972 | Marcovitch | |
| 3,785,193 | A | 1/1974 | Kinley et al. | |
| 3,818,734 | A | 6/1974 | Bateman | |
| 3,841,137 | A | 10/1974 | Mehdizadeh | |
| 3,911,707 | A | 10/1975 | Minakov et al. | |
| 3,986,383 | A | 10/1976 | Petteys | |
| 4,058,163 | A | 11/1977 | Yandell | |
| 4,069,573 | A | 1/1978 | Rogers, Jr. et al. | |
| 4,127,168 | A | 11/1978 | Hanson et al. | |
| 4,159,564 | A | 7/1979 | Cooper, Jr. | |
| 4,288,082 | A | 9/1981 | Setterberg, Jr. | |
| 4,324,407 | A | 4/1982 | Upham et al. | |
| 4,429,620 | A | 2/1984 | Burkhardt et al. | |
| 4,531,581 | A | 7/1985 | Pringle et al. | |
| 4,580,426 | A | 4/1986 | Zafred | |
| 4,588,030 | A | 5/1986 | Blizzard | |
| 4,619,129 | A | 10/1986 | Petkov et al. | |
| 4,697,640 | A | 10/1987 | Szarka | |
| 4,825,674 | A | 5/1989 | Tanaka et al. | |
| 4,848,469 | A | 7/1989 | Baugh et al. | |
| 4,890,682 | A | 1/1990 | Worrall et al. | |
| 5,027,894 | A | 7/1991 | Coone et al. | |
| 5,031,699 | A | 7/1991 | Artynov et al. | |
| 5,083,608 | A | 1/1992 | Abdrakhmanov et al. | |
| 5,220,959 | A | 6/1993 | Vance, Sr. | |
| 5,271,472 | A | 12/1993 | Leturno | |
| 5,297,633 | A | 3/1994 | Snider et al. | |
| 5,409,059 | A | 4/1995 | McHardy | |
| 5,435,400 | A | 7/1995 | Smith | |
| 5,472,057 | A | 12/1995 | Winfree | |
| 5,560,426 | A | 10/1996 | Trahan et al. | |
| 5,685,369 | A | 11/1997 | Ellis et al. | |
| 5,695,008 | A | 12/1997 | Bertet et al. | |
| 5,901,787 | A | 5/1999 | Boyle | |
| 6,021,850 | A | 2/2000 | Wood et al. | |
| 6,085,838 | A | 7/2000 | Vercaemer et al. | |
| 6,098,717 | A | 8/2000 | Bailey et al. | |
| 6,238,489 | B1 | 5/2001 | Lundell | |
| 6,253,850 | B1 | 7/2001 | Nazzai et al. | |
| 6,263,968 | B1 | 7/2001 | Freeman et al. | |
| 6,321,847 | B1 | 11/2001 | Brown | |
| 6,325,148 | B1 | 12/2001 | Trahan et al. | |
| 6,425,444 | B1 | 7/2002 | Metcalfe et al. | |
| 6,446,323 | B1 | 9/2002 | Metcalfe et al. | |
| 6,454,013 | B1 | 9/2002 | Metcalfe | |
| 6,457,531 | B1 | 10/2002 | Bangash et al. | |
| 6,457,532 | B1 * | 10/2002 | Simpson | 166/380 |
| 6,457,533 | B1 | 10/2002 | Metcalfe | |
| 6,527,049 | B2 | 3/2003 | Metcalfe et al. | |
| 6,543,552 | B1 * | 4/2003 | Metcalfe et al. | 175/57 |
| 6,543,816 | B1 | 4/2003 | Noel | |
| 6,702,029 | B2 | 3/2004 | Metcalfe et al. | |
| 6,722,441 | B2 * | 4/2004 | Lauritzen et al. | 166/380 |
| 6,860,329 | B1 | 3/2005 | Oosterling | |
| 2001/0045284 | A1 | 11/2001 | Simpson et al. | |
| 2002/0163192 | A1 | 11/2002 | Coulon et al. | |
| 2003/0183395 | A1 | 10/2003 | Jones | |

FOREIGN PATENT DOCUMENTS

| | | |
|---|---|---|
| EP | 0 961 007 | 12/1999 |
| FR | 1142975 | 6/1955 |
| GB | 1 485 099 | 9/1977 |
| GB | 2 086 282 | 5/1982 |
| GB | 2 088 438 | 6/1982 |
| GB | 2 261 238 | 5/1993 |
| GB | 2 272 924 | 1/1994 |
| GB | 2 320 734 | 7/1998 |
| GB | 2344606 | 6/2000 |
| GB | 2 392 933 | 3/2004 |
| WO | WO 84/00120 | 1/1984 |
| WO | WO 93/24728 | 12/1993 |
| WO | WO 97/06346 | 2/1997 |
| WO | WO 98/00626 | 1/1998 |
| WO | WO 99/18328 | 4/1999 |
| WO | WO 99/23354 | 5/1999 |
| WO | WO 00/37766 | 6/2000 |
| WO | WO 01/18354 | 3/2001 |
| WO | WO 01/18554 | 3/2001 |
| WO | WO 02/073000 | 9/2002 |
| WO | WO 02/081863 | 10/2002 |
| WO | WO 02/090713 | 11/2002 |
| WO | WO 02/103150 | 12/2002 |
| WO | WO 03/015954 | 2/2003 |
| WO | WO 03/048503 | 6/2003 |
| WO | WO 03/055616 | 7/2003 |
| WO | WO 03/064813 | 8/2003 |
| WO | WO 2004/007893 | 1/2004 |

OTHER PUBLICATIONS

The Proceeding of the Third (1993) International Offshore and Polar Engineering Conference, International Society of Offshore and Polar Engineers, vol. IV, 1993.

Rick Von Flatern, Oilfield Service Trio Target Jules Verne Territory, Industry News, Friday, Aug. 17, 2001.

GB Search Report dated Jul. 21, 2003 from GB Application No. 0306774.1.

GB Search Report dated Sep. 18, 2003 from GB Application No. 0312278.5.

U.K. Search Report, Application No. GB0406694.0, dated Jun. 17, 2004.

U.K. Search Report, Application No. GB0406693.2, dated Jun. 11, 2004.

U.K. Search Report, Application No. GB0406520.7, dated Apr. 29, 2004.

* cited by examiner

TUBING EXPANSION

CROSS-REFERENCE TO RELATED APPLICATIONS

This application claims benefit of Great Britain patent application serial number GB 0306774.1, filed Mar. 25, 2003, Great Britain patent application serial number GB 0312278.5, filed May 29, 2003, and Great Britain patent application number GB 0316050.4, filed Jul. 9, 2003 which are herein incorporated by reference, and this application is a continuation-in-art of U.S. patent application Ser. No. 10/618,419, filed Jul. 11, 2003, now U.S. Pat. No. 7,575,060 which claims benefit of Great Britain patent application serial number 0216074.5, filed Jul. 11, 2002.

BACKGROUND OF THE INVENTION

1. Field of the Invention

The present invention relates to a device for use in tubing expansion and to methods of expanding tubing. In particular, but not exclusively, embodiments of the present invention relate to devices and methods for use in expanding tubing downhole.

2. Description of the Related Art

In the oil and gas exploration and production industry, bores drilled to access subsurface hydrocarbon-bearing reservoirs are lined with tubing, known as casing and liner. Furthermore, strings of tubing may be located within the cased bore to, for example, carry production fluid to surface. Recently, there have been numerous proposals to use tubing which is expanded downhole, that is tubing of a first diameter is run into a bore and then expanded to a larger second diameter. This offers many advantages to the operator, primarily providing the ability to create lined bores which do not necessarily suffer a loss in internal diameter each time a string of tubing is located in the bore, beyond an existing section of tubing-lined bore.

Early proposals for expanding tubing downhole featured the use of cones or mandrels, which are driven through the tubing in order to expand the tubing. Other proposals include the use of roller expanders, some of which feature radially-urged rollers.

When tubing is expanded using a cone or mandrel, the expansion mode is different from when tubing is expanded using roller expanders. Typically, tubing expanded with a cone or mandrel tends to shorten in axial length whilst maintaining or suffering only a small reduction in wall thickness. Tubing expanded using roller expanders, however, tends to extend in axial length and experiences a reduction in wall thickness, caused by a wall thinning action.

These two different types of expansion devices offer various advantages and disadvantages depending upon the particular circumstances in which the device is employed.

Also, it is generally preferred to expand tubing in a top-down expansion procedure, as it is possible to recover the expansion device in the event that the tool becomes lodged in the tubing. However, when expanding tubing using an expansion cone or mandrel, it is conventional to employ a bottom-up expansion procedure. This is because it is necessary to apply a relatively large force on the cone from surface (by setting weight down on the cone), or to apply a relatively high pressure to the reverse face of the expansion cone (such as by supplying a pressurised fluid behind the cone), and it is not possible or safe to achieve the required loading or pressure on the cone in a top-down expansion procedure. This is particularly true for deviated (horizontal) wells and extended reach wells, where the forces required to expand tubing are, generally speaking, relatively high.

It is amongst the objects of embodiments of the present invention to provide improved devices and methods for use in expanding tubing downhole.

SUMMARY OF THE INVENTION

According to a first aspect of the present invention, there is provided a tubing expansion device comprising:

at least one expansion member adapted to expand a tubing by inducing a hoop stress in the tubing; and at least one further expansion member adapted to expand the tubing by inducing a compressive yield of the tubing.

It will be understood that the hoop stress in tubing is the stress in the tubing wall acting circumferentially in a plane perpendicular to an axis of the tubing. Tubing expanded by induced hoop stress experiences a different expansion mode compared to tubing expanded by compressive yield whereby the tubing tends to axially contract in length. Tubing expanded by compressive yield, however, tends to axially extend in length and experiences a reduction in the tubing wall thickness. The invention thus allows the relative advantages of these different expansion modes to be combined in a single device.

The expansion device may be adapted to be translated through tubing to be expanded, and may be adapted to be rotated. Alternatively, the expansion device may be adapted to be advanced through tubing to be expanded without rotation.

Preferably, the hoop stress inducing expansion member and the compressive yield inducing expansion member are arranged such that expansion of the tubing to a desired final diameter is carried out by the compressive yield inducing expansion member. The applicant has found that tubing expanded by compressive yield demonstrates improved material properties, particularly crush resistance, when compared to tubing expanded by a hoop stress, as disclosed in the Applicant's corresponding UK patent application No. 0216074.5, the disclosure of which is incorporated herein by way of reference. Alternatively, if desired or appropriate, expansion to a desired final diameter may be carried out using the hoop stress inducing expansion member.

Preferably, the hoop stress and compressive yield inducing expansion members are axially spaced, that is, axially separated, and/or circumferentially spaced, that is, spaced around a perimeter or circumference of the expansion device. The expansion members may be relatively axially and/or rotationally arranged according to at least one parameter of a tubing to be expanded, which may be selected from the group comprising: a pre-expansion diameter and/or wall thickness of the tubing to be expanded; a desired post expansion diameter and wall thickness of the tubing; an initial strength (yield strength) of the tubing to be expanded; Young's Modulus of the tubing material; anticipated work hardening of the tubing during expansion (which depends upon factors including the tubing material); a desired post-expansion strength and degree of collapse or crush resistance of the tubing; and an anticipated or desired degree of axial extension or contraction in length of the tubing. This final parameter may depend upon factors including the likelihood of the tubing becoming differentially stuck. This can occur, for example, when there is a large differential pressure between high pressure fluid (such as drilling fluid) in a borehole surrounding the tubing, and a formation having a relatively low formation pressure, such as a particularly permeable formation. This can cause the tubing to become adhered or stuck to a wall of the borehole. Accordingly, by balancing the axial extension and contraction effects of the different expansion modes, the tubing can be expanded without any change in axial length.

The expansion members may be provided spaced alternately in an axial and/or rotational direction, and may be provided on separate portions or bodies, or as parts of separate tools, coupled together to form the expansion device. The expansion device may thus further comprise a hoop stress inducing expansion portion and a compressive yield inducing expansion portion, each carrying respective hoop stress and compressive yield inducing expansion members. The device may therefore be modular in nature, allowing a tool including a desired axial arrangement of the expansion tool portions, and thus of the hoop stress and compressive yield inducing expansion members, to be provided, according to particular requirements of the expansion device and, in particular, depending upon one or more parameter of the tubing to be expanded, as discussed above. The portions or tools may be coupled together, and may be restrained against relative rotation. Alternatively, at least one of said portions or tools may be rotatable relative to at least one other portion or tool. Thus where the device is rotated and translated through tubing, at least one of said portions or tools may remain rotationally stationary relative to the tubing.

The hoop stress inducing expansion member may be adapted to contact the tubing over a majority of a circumference or perimeter of the tubing.

The compressive yield inducing expansion member may be adapted to contact the tubing over part of a circumference or perimeter of the tubing, and may contact the tubing in a point or line contact.

The expansion device may comprise a plurality of hoop stress inducing expansion members. Said expansion members may describe progressively increasing expansion diameters in a direction along an axial length of the device, to expand the tubing by progressively increasing degrees to a desired final diameter. The expansion device may additionally or alternatively comprise a plurality of compressive yield inducing expansion members. The compressive yield inducing expansion members may be arranged for movement to expansion positions describing progressively increasing expansion diameters in a direction along an axial length of the device. This may similarly facilitate expansion of the tubing to a desired diameter in progressive, incremental steps.

The expansion device may comprise a plurality of hoop stress and/or a plurality of compressive yield inducing expansion portions or tools, which may be axially alternating. Alternatively, a number of hoop stress inducing expansion portions may be coupled together and joined to one or more compressive yield inducing expansion portions, or vice versa, or indeed in any other suitable arrangement. In a further alternative, the expansion device may comprise at least one hoop stress inducing expansion member and at least one compressive yield inducing expansion member provided as a single tool, portion, body or part.

The hoop stress inducing expansion member may comprise a fixed expansion member. The hoop stress inducing expansion member may be fixed by coupling or mounting the member with respect to a remainder of the device, for rotation with respect to the tubing. Alternatively, the hoop stress inducing expansion member may be rotatable with respect to the tubing and may, for example, be rotatably mounted on or to a body of the device, such as by a bearing, swivel or the like. Thus where the tool is rotated on translation through the tubing, the hoop stress inducing expansion member may remain rotationally stationary relative to the tubing, save for any rotation due to a reaction force imparted on the member by the tubing.

The hoop stress inducing expansion member may comprise a fixed diameter expansion member, such as a cone or mandrel, but may alternatively comprise a shoulder, arm, finger or the like. The expansion member may be formed integrally with or provided on or coupled to a body of the expansion device. Alternatively, the hoop stress inducing member may comprise a compliant expansion member such as a compliant cone, mandrel or the like, such as that disclosed in the applicant's International patent application no. PCT/GB2002/005387, the disclosure of which is incorporated herein by way of reference. It will be understood that a compliant expansion member is capable of inward deflection, for example, in the event that a restriction is encountered, such as an area of tubing which cannot be expanded.

The device may further comprise a hoop stress inducing expansion tool, portion or body including a plurality of hoop stress inducing members, which may take the form of expansion rollers mounted for rotation about an axis substantially perpendicular to an axis of the tool, as disclosed in PCT/GB2002/005387. The expansion tool or portion may alternatively comprise a tapered expansion cone or mandrel with a plurality of rotary expansion members, such as rollers, rotatably mounted on the tapered cone, as disclosed in the applicant's International patent publication. no. WO 00/37766, the disclosure of which is also incorporated herein by way of reference.

The hoop stress inducing expansion member may take the form of a collapsible expansion cone, mandrel or the like, which may be movable between a collapsed and an expansion position, in the expansion position, the cone adapted for expanding the tubing.

The compressive yield inducing expansion member may comprise a rotary expansion member and may be rotatable with respect to the tubing. Preferably, the compressive yield inducing expansion member is rotatable relative to a body of the device about an expansion member axis.

The expansion device may be adapted to generate a drive force for translating the device with respect to or through the tubing. This may facilitate expansion of the tubing in a top-down procedure when, in an embodiment of the invention, using an expansion cone, mandrel or the like as the hoop stress inducing expansion member. The drive force may be generated on rotation of the expansion device. The compressive yield inducing expansion member may be adapted to generate a drive force on the tubing, the generated drive force serving for at least partly translating the device with respect to the tubing. The expansion device may be adapted to be translated through the tubing by a combination of an external axial force, which may be applied through a tubing string coupled to the device and the generated drive force, or the generated drive force may be sufficient to translate the device through the tubing without an externally applied axial force. An axis of the compressive yield expansion member may be skewed with respect to a body of the device. This may generate an axial drive force on rotation of the device. Where the device comprises a plurality of said expansion members, the members may be rotationally spaced and helically oriented with respect to a body of the device, as disclosed in WO 00/37766. The compressive yield inducing expansion member may be adapted to expand the tubing by a relatively small amount compared to the expansion generated by the hoop stress inducing expansion member. For example, the compressive yield inducing expansion member may expand the tubing by less than 50%, typically less than 25% and preferably by less than 10% of the total expansion achieved using the expansion device. The compressive yield inducing expansion member may include a gripping surface for gripping the tubing to impart a drive force on the tubing, and may, for example, have a knurled or toothed gripping surface, or a combination thereof.

The expansion device may be adapted to be rotated from surface by rotation of a tubing string coupled to the device, or by a downhole motor such as a turbine, positive displacement motor (PDM), electrical motor or the like.

The compressive yield inducing expansion member may be provided as part of a compressive yield inducing expansion member module releasably coupled to a body of the device as a unit, and the compressive yield inducing expansion member may be rotatably mounted on a spindle. The spindle may comprise a cantilevered spindle extending from a body of the device. The expansion device may comprise a bearing between the compressive yield inducing expansion member and a body of the device, and a sealed lubrication system for containing lubricant to facilitate rotation of the compressive yield inducing expansion member relative to the body. The spindle may be pivotally coupled to the body. An axis of the spindle may be disposed at an angle with respect to a main axis of the tool.

The compressive yield inducing expansion member may be radially moveably mounted with respect to a body of the device, for movement towards an expansion configuration describing an expansion diameter for expanding tubing to a predetermined diameter. The expansion member may be lockable in the extended configuration. The expansion member may additionally or alternatively be biased radially inwardly. Thus in the absence of an expansion force exerted on the compressive yield inducing expansion member, the expansion member may be biased towards a retracted configuration. The expansion member may be moveable in response to both: a) an applied mechanical force; and b) an applied fluid pressure force. The expansion member may be pivotally mounted with respect to a body of the device for movement towards the extended configuration. The above features are disclosed in the Applicant's UK patent application No. 0220933.6, the disclosure of which is incorporated herein by way of reference.

According to a second aspect of the present invention, there is provided a method of expanding tubing, the method comprising the steps of:

expanding the tubing at least in part by inducing a hoop stress in the tubing; and expanding the tubing at least in part by inducing a compressive yield of the tubing.

The method may comprise expanding the tubing at least in part by rotary expansion, but the tubing may alternatively be expanded without rotation.

The method may comprise providing an expansion device comprising a hoop stress inducing expansion member and a compressive yield inducing expansion member.

The method may comprise expanding the tubing to a first diameter by inducing one of a hoop stress in the tubing and a compressive yield of the tubing, and subsequently expanding the tubing to a second, greater diameter by the other one of inducing a hoop stress in the tubing and a compressive yield of the tubing. For example, the method may comprise providing at least one expansion member adapted to expand a tubing by inducing a hoop stress in the tubing; and at least one further expansion member adapted to expand the tubing by inducing a compressive yield of the tubing, and arranging said expansion members such that on translation of the tool through the tubing, expansion of the tubing to a first diameter is carried out using the hoop stress inducing expansion member, and expansion to a second, greater diameter is carried out using the compressive yield inducing expansion member, or vice versa.

The method may comprise arranging a hoop stress inducing expansion member and a compressive yield inducing expansion member relative to each other according to at least one parameter of tubing to be expanded, and the parameter may be selected from the group comprising: a pre-expansion diameter and/or wall thickness of the tubing to be expanded; a desired post expansion diameter and wall thickness of the tubing; an initial strength (yield strength) of the tubing to be expanded; the Young's Modulus of the tubing material; anticipated work hardening of the tubing during expansion; a desired post-expansion strength and degree of collapse resistance of the tubing; and an anticipated or desired degree of axial extension or contraction in length of the tubing. In one embodiment of the invention, the method may comprise expanding the tubing without any or with negligible change in axial length of the tubing.

The tubing may be expanded by progressively increasing amounts to a desired final diameter, by providing a plurality of expansion members. The method may comprise providing a plurality of expansion tool portions, one expansion tool portion carrying at least one hoop stress inducing expansion member and another expansion tool portion carrying at least one compressive yield inducing expansion member. The expansion tool portions may be provided with a combination of hoop stress inducing compressive yield inducing expansion members.

The method may comprise providing a hoop stress inducing expansion tool or portion and a compressive yield inducing expansion tool or portion, each having a respective expansion member, selecting a desired axial arrangement of the expansion tools or portions and coupling the tools or portions together according to the selected arrangement. The arrangement may be selected according to said at least one parameter defined above.

The method may comprise inducing a hoop stress in the tubing by bringing an expansion member into contact with a majority of a circumference or perimeter of the tubing. The method may comprise inducing a compressive yield by bringing an expansion member into a line or point contact with the tubing, and rotating said expansion member around the circumference or perimeter of the tubing.

The method may further comprise rotating the expansion device to generate a drive force for at least partly translating the device through the tubing. In an embodiment of the invention, the method comprises providing a compressive yield inducing expansion tool as disclosed in WO 00/37766, and with an axis of the compressive yield inducing expansion member at an angle with respect to a main axis of the device, and rotating said tool to generate the drive force. A hoop stress inducing expansion member such as a cone, mandrel or the like may be coupled to and thus driven by said expansion tool.

At least one of the hoop stress inducing and compressive yield inducing expansion members may have an expansion member axis, the axis disposed at an angle with respect to a main axis of the device. Where the compressive yield inducing expansion member comprises a rotary expansion member, said expansion member may be rotatable about an expansion member axis, said axis disposed at an angle with respect to a main axis of the device. The expansion member axis may converge with the tool main axis towards a leading end of the device. The compressive yield inducing expansion member may be rotatably mounted on a spindle, which may be disposed at an angle with respect to the device main axis, of the expansion member may include a spindle which is rotatable relative to a body of the device, the spindle disposed at an angle with respect to the device main axis.

According to a third aspect of the present invention, there is provided a method of expanding tubing, the method comprising the steps of:

determining at least one parameter of a tubing;

providing a tubing expansion device having at least one hoop stress inducing expansion member and at least one compressive yield inducing expansion member mounted for rotation with respect to a body of the tool, and with said hoop stress inducing expansion member and said compressive yield inducing expansion member provided in a desired arrangement relative to each other selected depending upon said parameter; and translating the tubing expansion device through the tubing.

The step of providing said expansion device may comprise selecting the tubing expansion device from a group comprising a plurality of expansion devices each having a different arrangement of said hoop stress and compressive yield inducing expansion members. Thus an expansion device may be selected which is most appropriate for expanding the tubing, depending upon said determined parameter.

Alternatively, the step of providing said expansion device may comprise assembling an expansion device with said hoop stress and compressive yield inducing expansion members provided in a desired arrangement selected depending upon said determined parameter.

The parameter may be selected from the group comprising a pre-expansion diameter and wall thickness of the tubing to be expanded; a desired post expansion diameter and wall thickness of the tubing; an initial strength (yield strength) of the tubing to be expanded; the Young's Modulus of the tubing material; anticipated work hardening of the tubing during expansion; a desired post-expansion strength and degree of collapse resistance of the tubing; and an anticipated or desired degree of axial extension or contraction in length of the tubing.

According to a fourth aspect of the present invention, there is provided a tubing expansion device comprising at least one fixed expansion member; and at least one rotary expansion member mounted for rotation with respect to a body of the tool.

According to a fifth aspect of the present invention, there is provided a method of expanding tubing, the method comprising the steps of:

providing a tubing expansion device having at least one fixed expansion member and at least one rotary expansion member mounted for rotation with respect to a body of the tool; and translating the tool through tubing to be expanded to expand the tubing in part by the fixed expansion member and in part by the rotary expansion member.

BRIEF DESCRIPTION OF THE DRAWINGS

Embodiments of the present invention will now be described, by way of example only, with reference to the accompanying drawings, in which.

DETAILED DESCRIPTION OF THE PREFERRED EMBODIMENT

Figure 1:
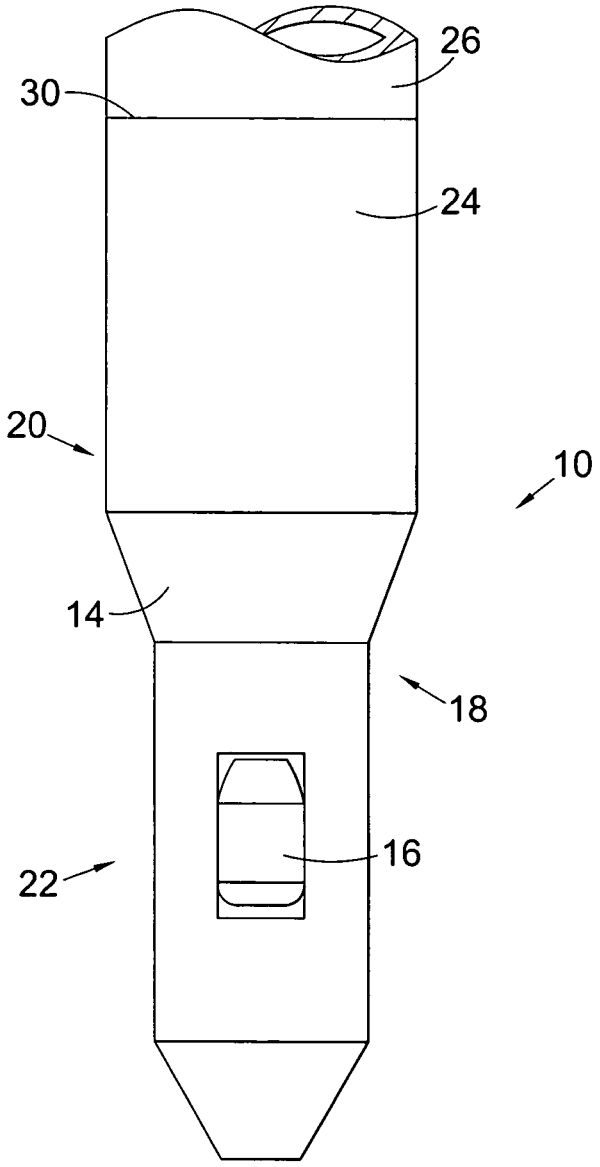
FIG. 1 is a schematic view of a tubing expansion device in accordance with an embodiment of the present invention.
Figure 2:
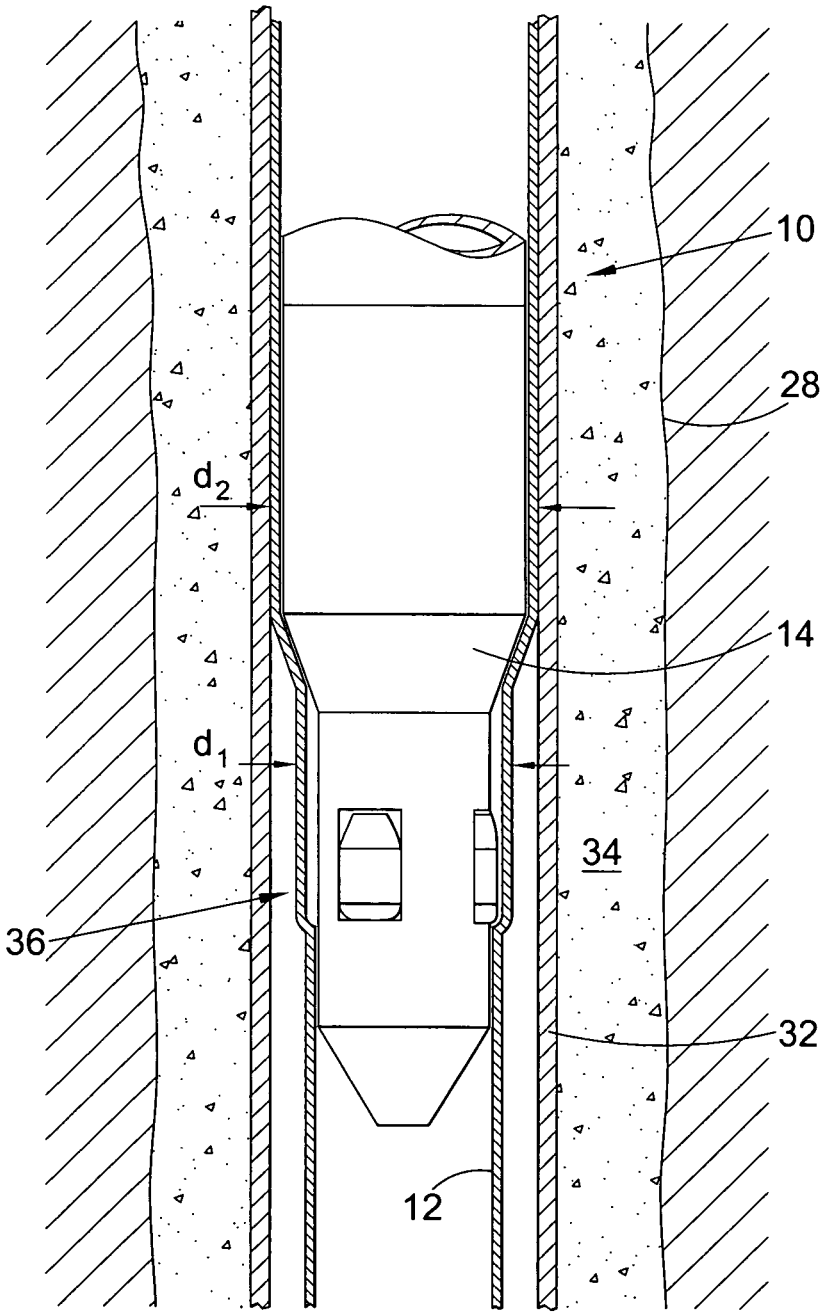
FIG. 2 is a view of the tubing expansion device of FIG. 1 shown in use.

Turning firstly to FIG. 1, there is shown a schematic view of a tubing expansion device in accordance with an embodiment of the present invention, the device indicated generally by reference numeral 10. The expansion device 10 is shown in FIG. 2 in use, during expansion of tubing in the form of an expandable liner 12. The expansion device 10 comprises at least one hoop stress inducing expansion member, in this embodiment, a fixed expansion member in the form of an expansion cone or mandrel 14 and at least one compressive yield inducing expansion member, in this embodiment, a rotary expansion member in the form of rotary expansion cone 16. The cone 16 is mounted for rotation with respect to a body 18 of the expansion device 10. The expansion device 10 is translated through the liner 12 to expand the liner to a greater diameter and, as will be described below, this expansion is achieved in part by the mandrel 14 and in part by the rotary expansion cone 16.

In more detail, the expansion device 10 comprises two expansion tool portions in the form of a hoop stress inducing expansion tool portion 20 and a compressive yield inducing expansion tool portion 22. The expansion tool portion 20 includes a body 24 which is coupled to a string of tubing 26 for running the expansion device 10 into a borehole 28, the body 24 coupled to the tubing string 26 by, for example, a conventional pin and box type connection 30. The expansion cone 14 extends between the body 24 and the expansion tool portion 22, which may comprise one of a number of types of rotary expansion tools, as will be described below.

In FIGS. 1 and 2, the compressive yield inducing expansion tool portion 22 comprises a rotary expansion tool having three rotary expansion cones 16, which are activated in response to applied fluid pressure to move from a retracted configuration (FIG. 1) to an extended, expansion configuration (FIG. 2), for expanding the liner 12.

Considering FIG. 2 in more detail, the expansion device 10 is shown run into a casing 32 previously located in the borehole 28 and cemented at 34, in a conventional fashion. The expandable liner 12 has been located within the casing 32 suspended, for example, through a temporary connection to the expansion device 10. The expansion device 10 is shown in FIG. 2 following activation and translation of the device part way through the liner 12. The device 10 is activated by supplying pressurized fluid to the device, to urge the rotary expansion cones 16 outwardly, and is rotated during translation through the liner 12. This causes an initial partial expansion of the liner 12 to a first diameter d1, as indicated by the area 36 in FIG. 2.

The expansion device 10 is translated through the liner 12 in a top-down expansion procedure, thus following initial expansion to the diameter d1, the liner 12 is then expanded to a greater diameter d2 by the expansion cone 14. This is achieved by exerting a relatively large axial force on the device 10, for example, by setting weight down upon the expansion device 10 from surface through the tubing string 26. This process is continued until the liner 12 has been expanded over a desired length, and the expansion device 10 is then deactivated and recovered to surface.

The liner 12 may act as a liner extending from a shoe of the casing 32 (the lowermost casing section), for gaining access to a hydrocarbon bearing formation. However, it will be understood that the tubing 12 may equally take the form of a straddle/patch or other solid tubing, or a sand exclusion based tubing assembly such as the applicant's ESS (Trademark) sandscreen, of the type disclosed in International Patent Publication No WO97/17524.

Figure 3:
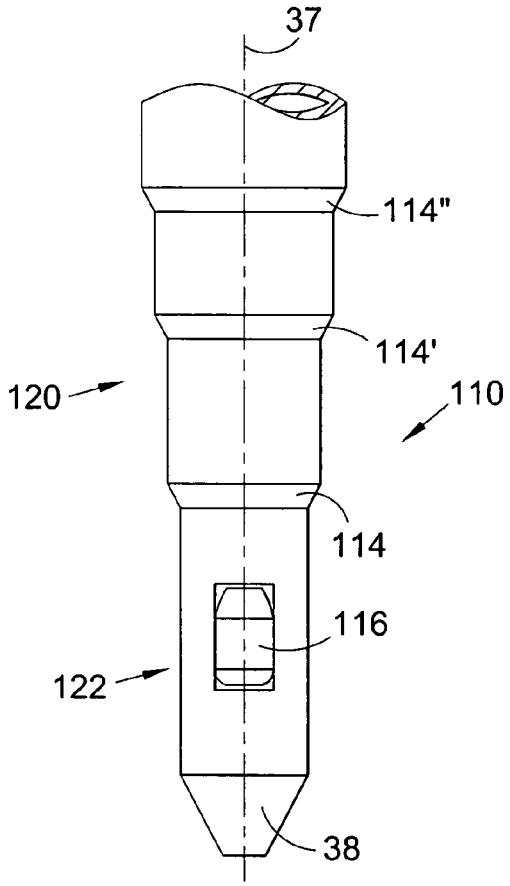
FIGS. 3, 4, 5, 5A, 5B, 5C, 5D and 5E are schematic views of tubing expansion devices in accordance with alternative embodiments of the present invention.

Turning now to FIG. 3, there is shown a view of a tubing expansion device in accordance with an alternative embodiment of the present invention, the device indicated generally by reference numeral 110. Like components of the expansion device 110 with the device 10 of FIGS. 1 and 2 share the same reference numerals, incremented by 100. For brevity, only the differences between the devices 110 and 10 will be described herein in detail.

The expansion device 110 includes a hoop stress inducing expansion tool portion 120 comprising three separate expansion mandrels 114, 114', 114" which are of progressively increasing maximum external diameter in a direction along a main axis 37 of the device away from a nose 38 of the tool. In use and during translation of the expansion device 110 through tubing, such as the liner 12 of FIG. 2, expansion of the liner out to a final diameter (such as the diameter d2) is achieved progressively, each expansion cone 114, 114', 114" providing a small increase in the diameter of the tubing.

Figure 4:
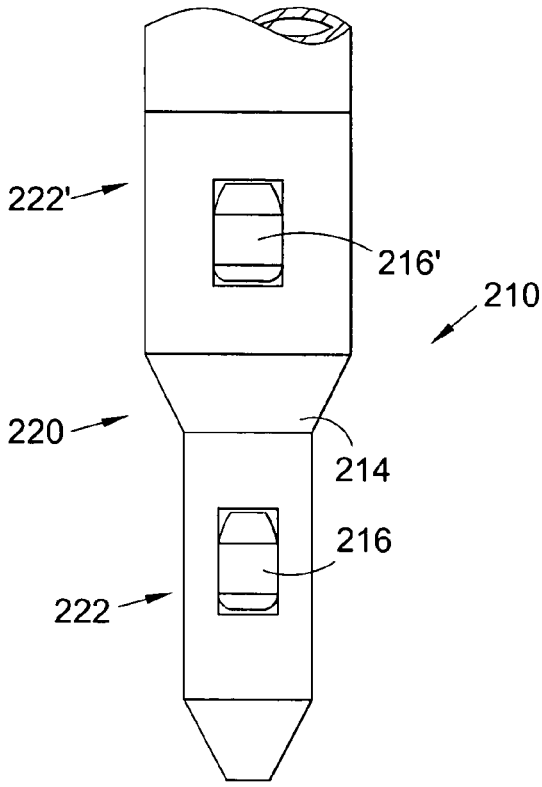

FIG. 4 is a view of a tubing expansion device in accordance with a further alternative embodiment of the present invention, the device indicated generally by reference numeral 210. Like components of the expansion device 210 with the device 10 of FIGS. 1 and 2 share the same reference numerals, incremented by 200. For brevity, only the differences between the devices 210 and 10 will be described herein in detail.

The expansion device 210 includes two compressive yield inducing expansion tool portions 222, 222' which are axially spaced along the expansion device 210, and a hoop stress inducing expansion tool portion 220 comprising expansion cone 214, which extends between the rotary portions 222 and 222'.

The expansion tool portion 222' includes three rotary expansion cones 216' (one shown in FIG. 4) which describe a larger expansion diameter than the cones 216 of the expansion tool portion 222. Translation of the expansion device 210 through tubing such as the liner 12 of FIG. 2 provides a progressive increase in diameter of the tubing out to a maximum diameter determined by the rotary expansion cones 216'. The arrangement of the expansion device 210 is such that final expansion of the tubing is by the expansion cones 216', offering advantages over fixed diameter mandrels or cones. This is the applicant has been found that mechanical properties of tubing expanded using a rotary expansion tool, such as the expansion tool portion 222', exhibit different characteristics, such as improved post expansion strength and work hardening characteristics, compared to tubing expanded using cones or mandrels.

Figure 5:
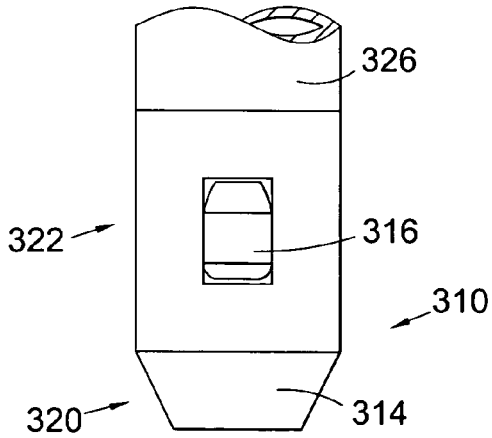

Turning now to FIG. 5, there is shown a tubing expansion device in accordance with a yet further alternative embodiment of the present invention, the device indicated generally by reference numeral 310. Like components of the expansion device 310 with the device 10 of FIGS. 1 and 2 share the same reference numerals, incremented by 300. For brevity, only the differences between the devices 310 and 10 will be described herein in detail.

The expansion device 310 includes a hoop stress inducing expansion portion 320 comprising a mandrel 314 at a leading end 338 of the device, for expanding tubing such as the liner 12 to a first diameter. The device also includes a compressive yield inducing expansion tool portion 322, axially spaced from mandrel 314, and comprising rotary expansion cones 316, for expanding the liner to a second greater diameter.

Figure 5A:
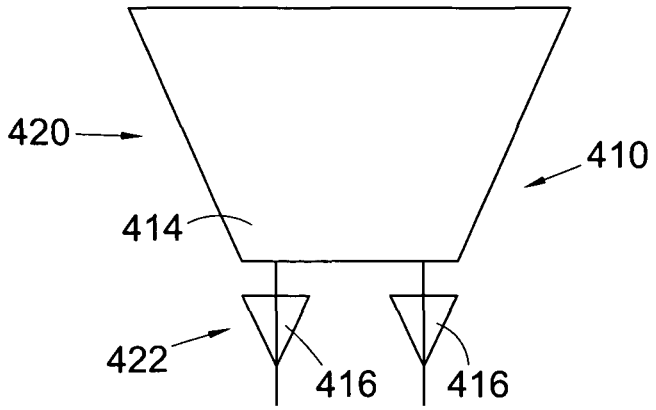
Figure 5B:
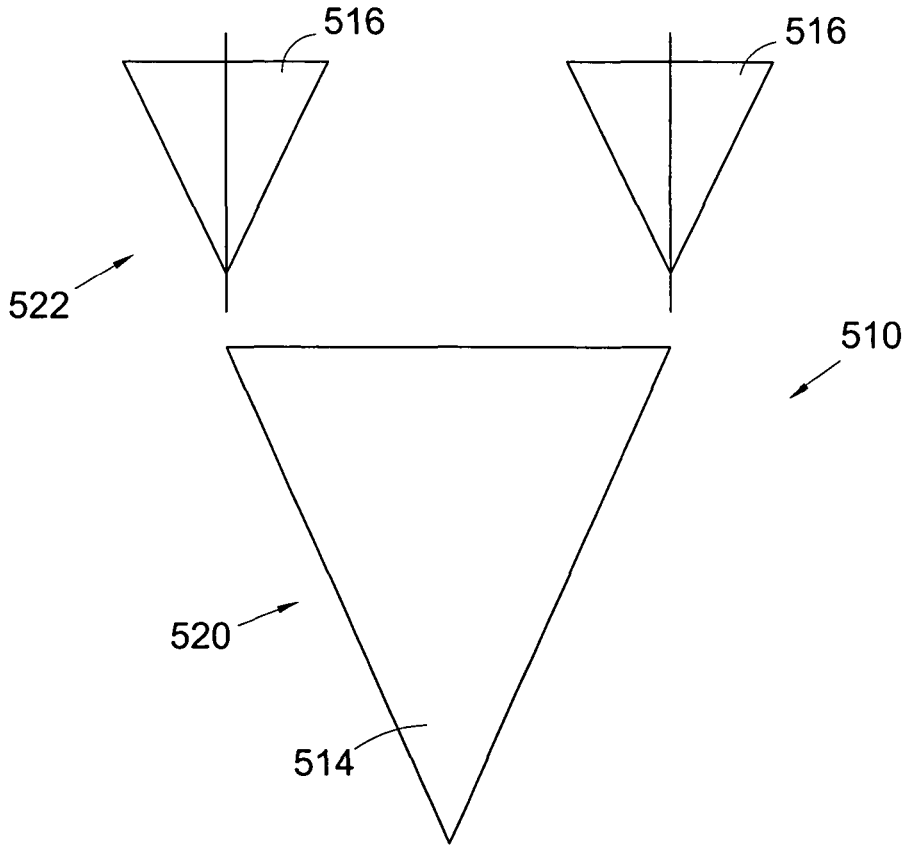

Turning now to FIGS. 5A and 5B, there are shown tubing expansion devices in accordance with yet further alternative embodiments of the present invention, the devices indicated generally by reference numerals 410 and 510, respectively. Like components of the expansion devices 410 and 510 with the device 10 of FIGS. 1 and 2 shares the same reference numerals, incremented by 400 and 500, respectively. For brevity, only the differences between the devices 410/510 and 10 will be described herein in detail.

FIG. 5A is a schematic view of the expansion device 410, which includes a hoop stress inducing expansion tool portion 420 having an expansion cone 414, and a compressive yield inducing expansion tool 422 having a plurality of rotary expansion cones 416. The rotary expansion cones 416 are mounted at a leading end of the expansion cone 414 for carrying out an initial expansion of tubing such as the liner 12, followed by expansion to a desired final diameter by the expansion cone 414. The expansion device of FIG. 5B is similar to the device 410 of FIG. 5A, except the device 510 includes a hoop stress inducing expansion tool portion 520 having an expansion cone 514 at a leading end of the device, with a compressive yield inducing expansion tool 522 having a plurality of rotary expansion cones 516 at a trailing end of the expansion cone 514, for expanding the tubing to a desired final diameter.

Figure 5C:
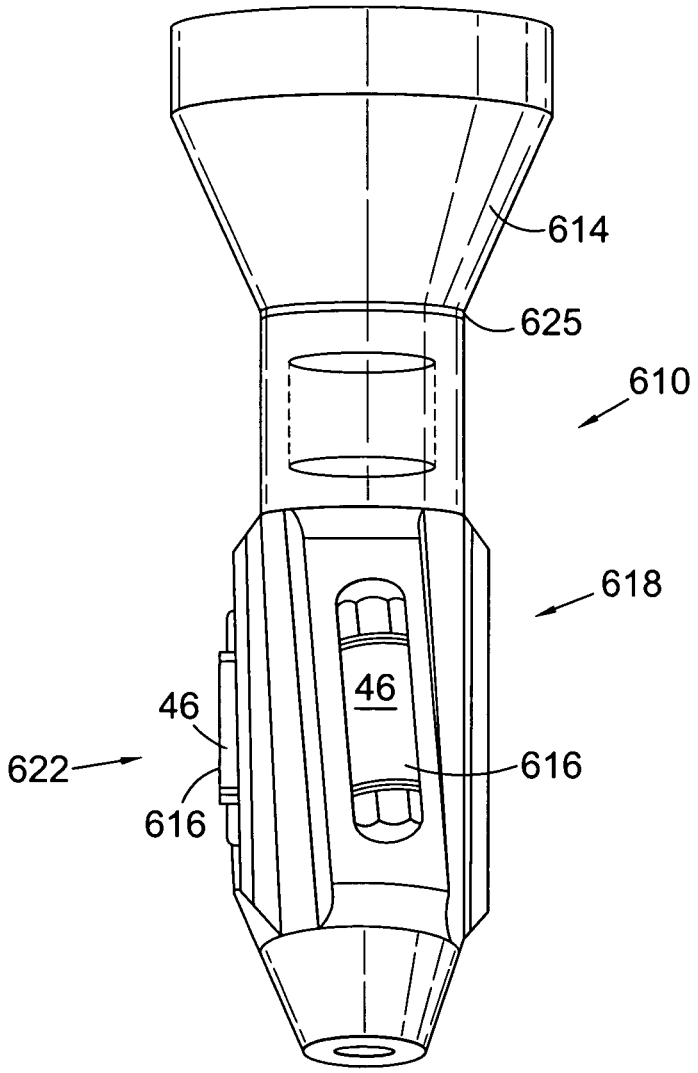

Turning now to FIG. 5C, there is shown an expansion device 610 in accordance with a further alternative embodiment of the present invention. The expansion device 610 is similar to the expansion device 10 of FIG. 1, and like components share the same reference numerals, incremented by 600. In a similar fashion to the device 10, the device 610 includes a compressive yield inducing expansion tool 622 of a type disclosed in WO 00/37766, the expansion tool 622 acting as a tractor. In the illustrated embodiment, the rotary expansion rollers 616 are mounted in the tool body 618 with their axes skewed with respect to a main axis of the device 610, in a helical configuration. An expansion cone 614 is coupled to the expansion tool 622 optionally via a swivel 625 and, on activation and rotation of the expansion tool 622 within tubing such as the liner 12, the expansion rollers 616 generate a drive force on the liner 12 to pull the expansion cone 614 through the liner 12. The swivel 625 allows the expansion cone 614 to be advanced through the liner 12 with little or no rotation. The rollers 616 cause a partial expansion of the liner 12, however, the primary expansion is by the expansion cone 614. The rollers 616 optionally have knurled, toothed or otherwise shaped or textured gripping surfaces 46, to improve grip with the liner 12.

The expansion device 610 is rotated either from surface through a string of tubing (not shown) coupled to the compressive yield inducing expansion tool 622, or by a downhole motor such as a turbine, PDM or electrical motor. The expansion device 610 thus acts as a tractor for the expansion cone 614 and allows tubing such as the liner 12 to be expanded in a top-down expansion procedure utilizing an expansion cone or mandrel, overcoming problems associated with prior proposals.

In particular, as noted above, solid cone expansion forces are high, and expansions are typically performed from the bottom up because it is not possible (or safe) to achieve the required set down weight to go from the top down in most applications. However, by utilizing the expansion tool 622 as a tractor and thus by applying the tractor load as close to the cone 614 as possible, this reduces the surface loads needed to complete cone expansion.

Figure 5D:
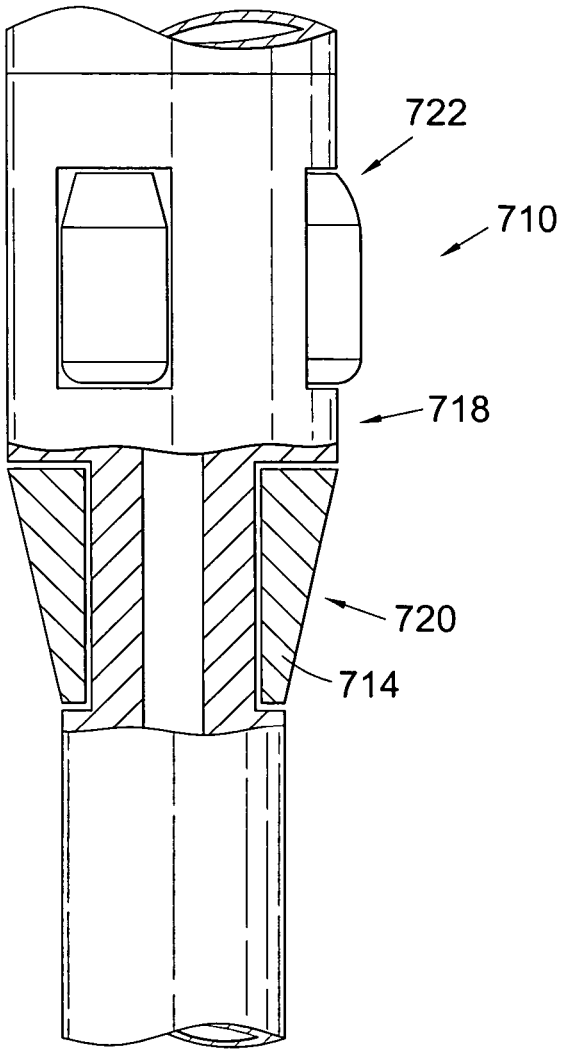

Turning now to FIG. 5D, there is shown an expansion device 710 in accordance with a further alternative embodiment of the present invention, shown in partial longitudinal cross-section. The expansion device 710 is essentially similar to the expansion device 310 of FIG. 5, except the device 710 includes a hoop stress inducing expansion tool having an expansion cone 714 rotatably mounted on a body 718 of the device 710 by a bearing (not shown). This facilitates translation of the expansion device 710 through tubing to be expanded, such as the liner 12, with little or no rotation of the cone 714 relative to the liner 12.

Figure 5E:
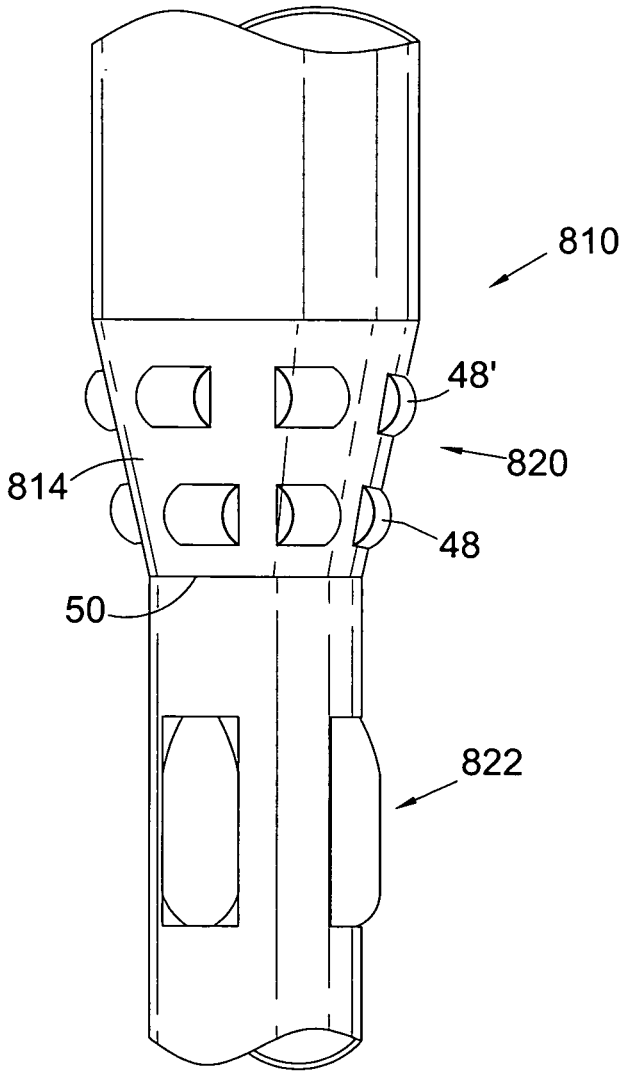

Turning now to FIG. 5E, there is shown an expansion device 810 in accordance with a further alternative embodiment of the present invention. The expansion device 810 is similar to the expansion device 10 of FIG. 1 and like components with the expansion device 10 share the same reference numerals, incremented by 800.

The expansion device 810 includes a hoop stress inducing expansion tool 820 having a tapered support mandrel 814 with two sets of expansion rollers 48, 48' mounted with their axes perpendicular to a main axis of the device 810. The sets of expansion rollers 48, 48' describe progressively increasing expansion diameters and may be compliant. The hoop stress inducing expansion tool 820 is connected via a swivel 50 to a compressive yield inducing expansion tool 722, and on activation of the device 810 and translation through the liner 12, there is little or no rotation of the cone 814 relative to the liner 12.

As discussed above, expansion of tubing by inducing a hoop stress in the tubing using a cone or mandrel tends to cause an axial contraction in the length of the tubing, whilst expansion by inducing a compressive yield using rotary expansion tools tend to thin the wall of tubing and cause an axial extension. Thus, by providing a combination of hoop stress and compressive yield inducing expansion members in the expansion devices 10 to 810 of FIGS. 1 to 5E, it is possible to combine these expansion modes to achieve expansion of the liner 12 without causing extension or contraction of the liner. Also, if desired, a more controllable extension or contraction of the liner can be achieved by balancing the effects of the hoop stress and compressive yield inducing expansion members.

In a further alternative embodiment not illustrated herein, an expansion device may be provided combining the theories of any of FIGS. 1 to 5E. For example, the expansion device 110 of FIG. 3 may comprise a plurality of rotary expansion tool portions 122, which may be provided in series or axially spaced between expansion cones such as the cones 114, 114' and 114". Alternatively, a device may be provided comprising any desired configuration or pattern of hoop stress and compressive yield inducing expansion cones, which may be spaced axially and/or rotationally around a body of the device.

Furthermore, the particular arrangement or configuration of the hoop stress and compressive yield inducing expansion cones may be selected according to one or more determined parameters of the tubing to be expanded. These parameters may include the diameter and wall thickness of the tubing to be expanded; the initial yield strength of the tubing to be expanded; the Young's Modulus of the tubing material; the anticipated work hardening experienced by the tubing during expansion (which depends upon factors including properties of the material from which the tubing is formed); the desired end result in terms of the desired final strength and collapse resistance of the tubing; and the desired final length of the tubing, which depends upon the particular combination of hoop stress and compressive yield inducing expansion members used, as described above. This final parameter may be of particular interest where it is desired to avoid differential sticking of tubing, such as in an open hole environment. This is because the forces required to overcome differential sticking can cause problems with conventional expansion devices, such as failure of connections between sections of liner tubing.

Turning now generally to FIGS. 6 to 36, there are shown various views of tubing expansion tools incorporating rotary expansion members, of types suitable for forming the rotary expansion tool portion 22 to 822 of any one of FIGS. 1 to 5E, respectively.

Figure 6:
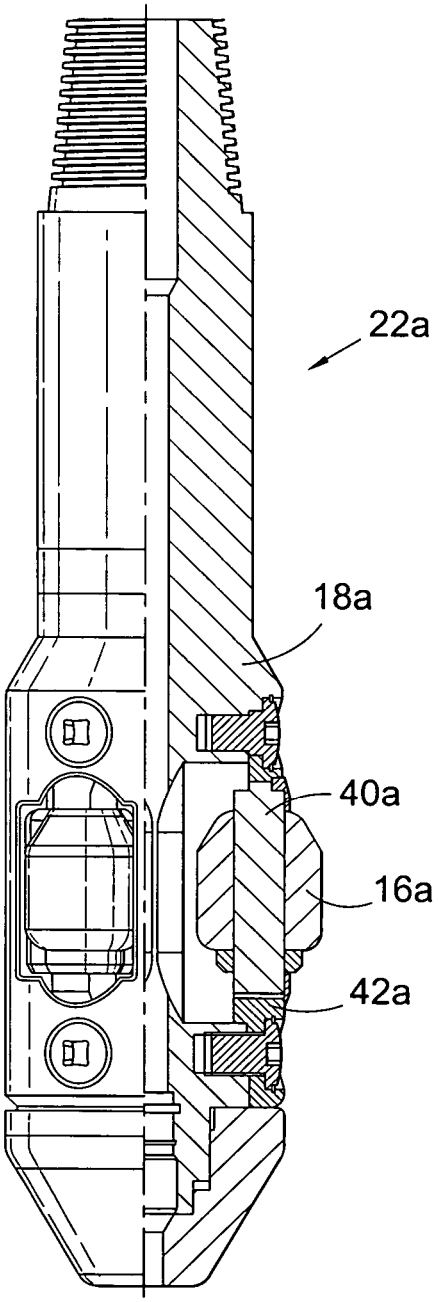
FIG. 6 is a view of a view of an expansion tool forming part of any one of the expansion devices of FIGS. 1 to 5E, in accordance with an embodiment of the present invention.

Turning initially to FIG. 6, there is shown a longitudinal half-sectional view of a rotary expansion tool 22*a*, which takes the form of the applicant's commercially available rotary expansion tool, manufactured according to the principles of International patent publication No. WO 0/37766, the disclosure of which is incorporated herein by way of reference. Each rotary expansion cone 16*a* is rotatably mounted on a spindle 40*a*, which is in turn mounted on a piston 42*a* for movement between a retracted position shown in the left half of FIG. 6 and an extended, expansion position, shown in the right half of FIG. 6. The expansion tool 22*a* includes three such rotary expansion cones 16*a* spaced around the circumference of the tool body 18*a*.

Figure 7:
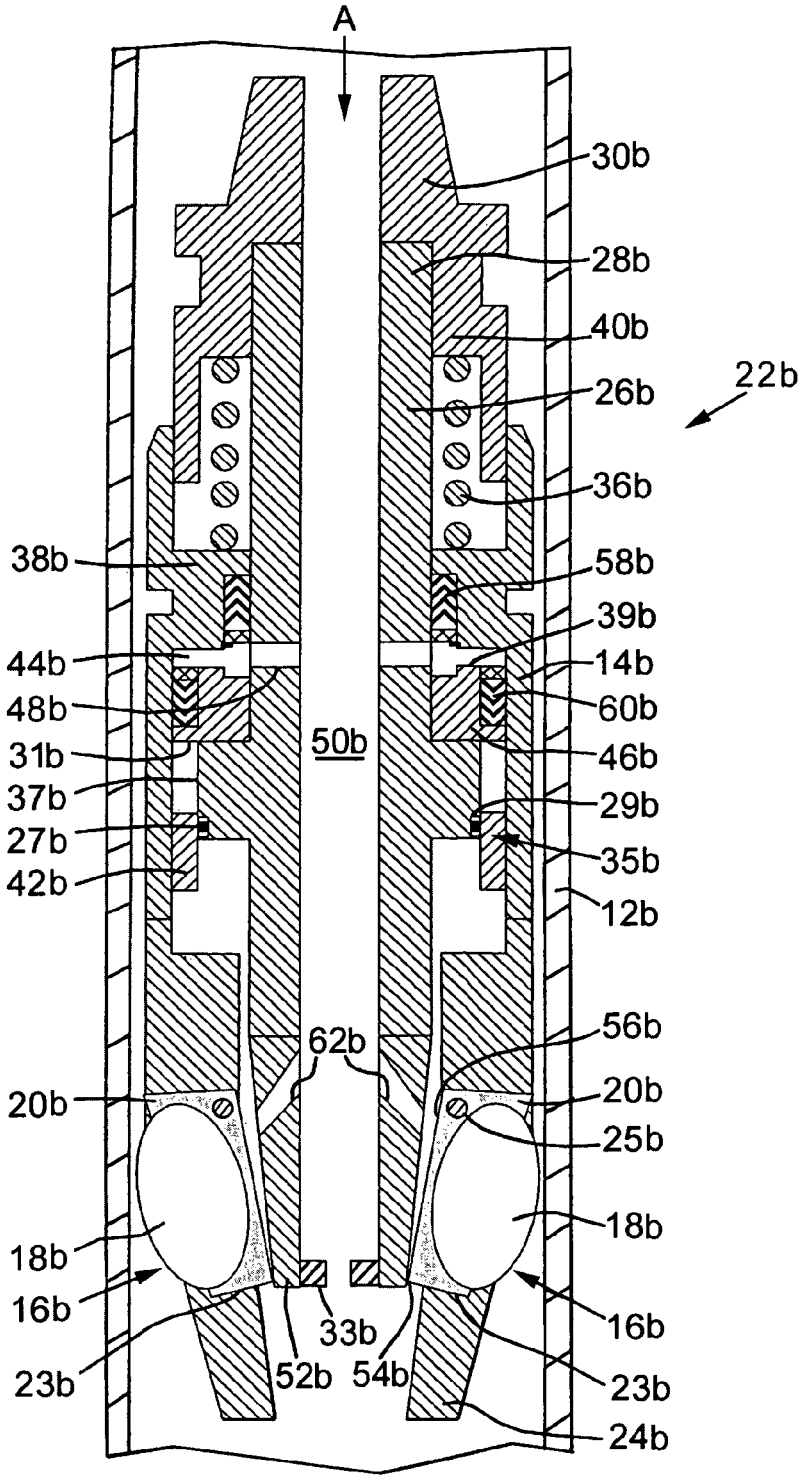
FIG. 7 is a longitudinal sectional view of an expansion tool forming part of any one of the expansion devices of FIGS. 1 to 5E, in accordance with an alternative embodiment of the present invention, the tool shown in a deactivated configuration and located in tubing to be expanded.

Turning now to FIG. 7, there is shown a longitudinal sectional view of an alternative tubing expansion tool 22*b*. The tool 22*b* is shown located in a liner 12*b* which is to be diametrically expanded. The expansion tool 22*b* is shown in FIG. 7 in a de-activated configuration.

Figure 8:
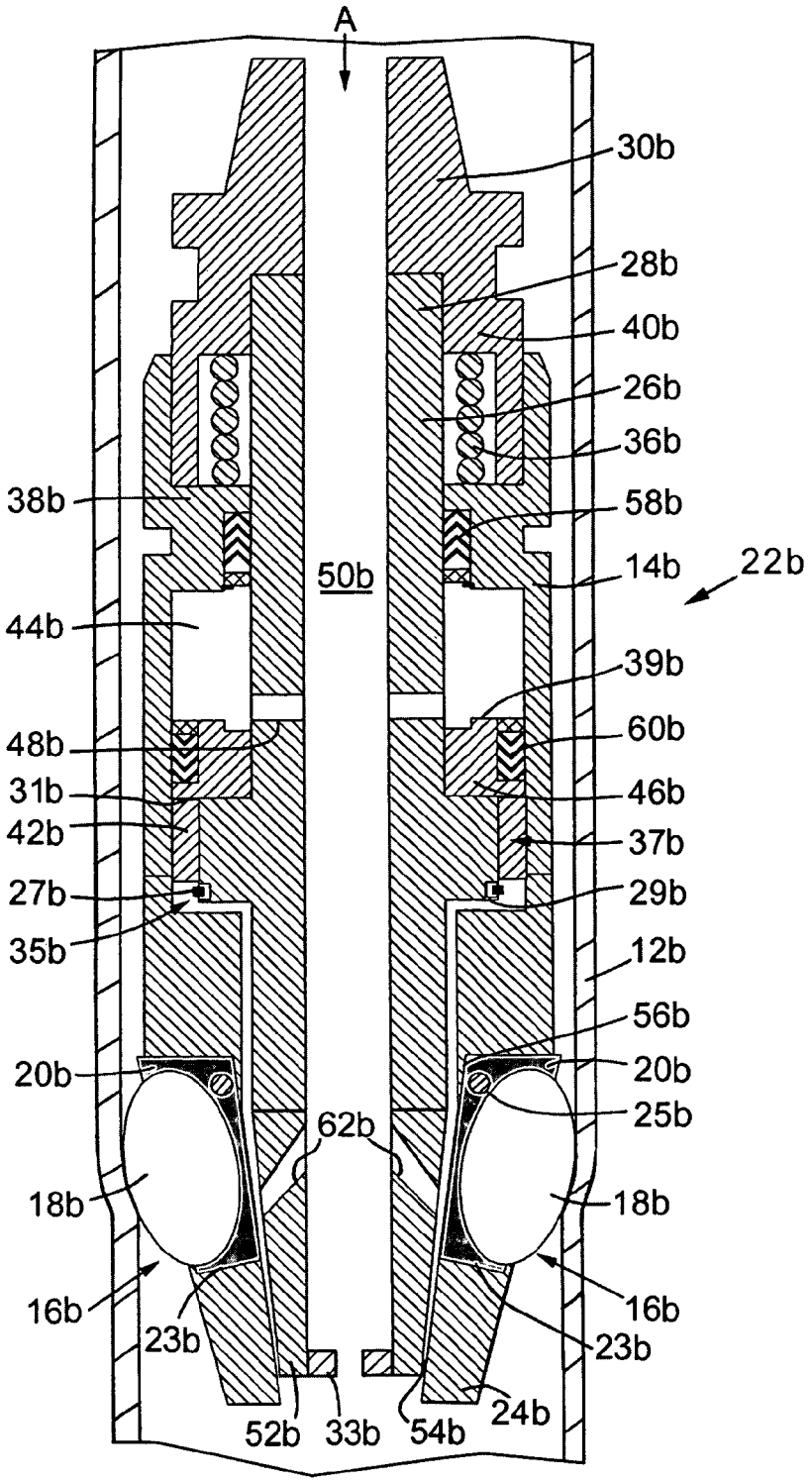
FIG. 8 is a view of the expansion tool of FIG. 7, drawn to a larger scale and shown in an expanded configuration during expansion of the tubing.

The expansion tool 22*b* comprises a hollow body 14*b* and four expansion members 16*b*, each radially moveably mounted on the body 14*b*, for movement towards an extended configuration describing an expansion diameter, as shown in FIG. 8. Each expansion member 16*b* includes an oval section expansion roller 18*b* mounted on a piston 20*b*, which is radially moveable in slots 22*b* in a tapered lower end 24*b* of the body 14*b*. Alternatively, the roller 18*b* is mounted in a body or housing pivotably mounted to the tool body 14*b*, for example, by a pivot such as the pivot 25*b* shown in the drawings.

A hollow activating mandrel 26*b* is mounted in the body 14*b* for urging the rollers 18*b* to the extended configuration of FIG. 8. The mandrel 26*b* is moveable between a deactivating position shown in FIG. 7 and an activating position shown in FIG. 8, in response to either an applied mechanical force, an applied fluid pressure force or a combination of the two. A lower end 52*b* of the mandrel 26*b* is truncated cone-shaped, and defines a cam surface 54*b* for urging the rollers 18*b* to the extended configuration, as will be described below. The expansion tool 22*b* also includes a locking assembly 35*b* comprising a snap ring 27*b* located in a groove 29*b* in the mandrel 26*b*, for locking the rollers 18*b* in the extended configuration of FIG. 8.

An upper end 28*b* of the mandrel 26*b* is coupled to a connecting sub 30*b* which allows a mechanical force to be exerted on the mandrel 26*b* to move the mandrel between the deactivating and activating positions. The connecting sub 30*b* is in-turn coupled to, for example, the mandrel 14 of the tool 10 (FIG. 1), and the sub 30*b* is axially moveable relative to the body 14. The tool 10 also includes a biasing member comprising a spring 36*b*, which biases the mandrel 26*b* towards the deactivating position of FIG. 7. In the deactivating position, the mandrel 26*b* de-supports the rollers 18*b*, allowing the rollers to be moved radially inwardly, towards the retracted position of FIG. 7.

The biasing spring 36*b* is located between a shoulder 38*b* in the body 14*b* and a shoulder 40*b* of the connecting sub 30*b*. As will be described below, when the force on the mandrel 26*b* is removed or reduced, the spring 36*b* urges the sub 30*b* and mandrel 26*b* towards the deactivating position of FIG. 7, to de-support the rollers 18*b*.

The tool body 14*b* includes an annular guide ring 42*b* which guides the mandrel 26*b* and a cylinder 44*b* are defined by an annular floating piston 46*b* mounted between the mandrel 26*b* and the body 14*b*. The mandrel 26*b* includes a number of ports 48*b* extending through the wall of the mandrel which allow fluid communication between a central bore 50*b* of the tool 22*b* and the cylinder 44*b*. Seals (not shown) are provided between the piston 46*b* and a shoulder 37*b* of the mandrel 26*b* such that the piston defines an upper piston area 39*b* and a smaller, lower piston area 31*b*, and further seals 58*b*, 60*b* are provided above and below the cylinder 44*b*.

The seals 58*b*, 60*b* ensure that pressure is applied to the upper piston area 39*b* and that there is no leakage into the chamber of spring 36*b*, or past the piston 46*b*. Also, a flow restriction nozzle 33*b* is provided at the lower end of the mandrel 26*b*. As will be described below, both the differential piston area and the nozzle 33*b* allow movement of the mandrel 26*b* by application of fluid pressure, to urge the rollers 18*b* to the extended configuration. Flow ports 62*b* in the cone 52*b* allow flow of cooling fluid to the rollers 18*b* during expansion of the liner 12*b*.

A method of operation of the expansion tool 22*b* will now be described, with reference to FIGS. 7 and 8.

In a top-down expansion procedure, the tool 22*b* is run into a well borehole on coiled tubing and into the liner 12*b*. When the tool 22*b* has been located at the top of the liner 12*b*, fluid is circulated through the bore 50*b* of the tool, exiting through the nozzle 33*b*. The nozzle 33*b* restricts fluid flow and increases the back-pressure of fluid in the bore 50*b*, pressurizing fluid in the cylinder 44*b* relative to the fluid acting on the lower piston area 31*b*. The combination of the back-pressure of the fluid in the cylinder 44*b* and the differential piston area urges the piston 46*b* downwardly, carrying the mandrel 26*b* downwardly to the activating position of FIG. 8. During this movement, the cam surface 54*b* of the mandrel cone 52*b* abuts the roller pistons 20*b*, urging the pistons radially outwardly in their slots 23*b*, to the extended configuration of FIG. 8.

At the same time, the tool 22*b* is rotated by an appropriate downhole motor, or from surface and the rollers 18*b* are progressively moved outwardly to describe an expansion diameter greater than the unexpanded internal diameter of the tubing 12*b*. When the mandrel 26*b* has moved fully downwardly, the snap ring 27*b* locks out against the guide ring 42*b*, to lock the mandrel 26*b* against return movement to the deactivating position of FIG. 1. The mandrel 26*b* is thus locked in the activating position, and maintains the rollers 18*b* in the extended configuration of FIG. 8.

The rotating expansion tool 22*b* is then translated axially through the tubing 12*b*, and the rollers 18*b* diametrically expand the liner 12*b* to a greater internal diameter, as shown in FIG. 8. By verifying that the snap ring 27*b* has locked out to restrain the mandrel 26*b* in the activating configuration, this indicates to the operator that the rollers 18 were correctly located in the extended configuration during the expansion procedure. Accordingly, this provides an indication that the tubing 12*b* has been expanded to the desired, predetermined internal diameter described by the rollers 18*b* in the extended configuration. The snap ring 27*b* is then released and the mandrel 26*b* retracts to the deactivating position under the force of the spring 36*b*, thus de-supporting the rollers 18*b*. The rollers 18*b* can then be returned to the retracted configuration of FIG. 7.

Figure 9:
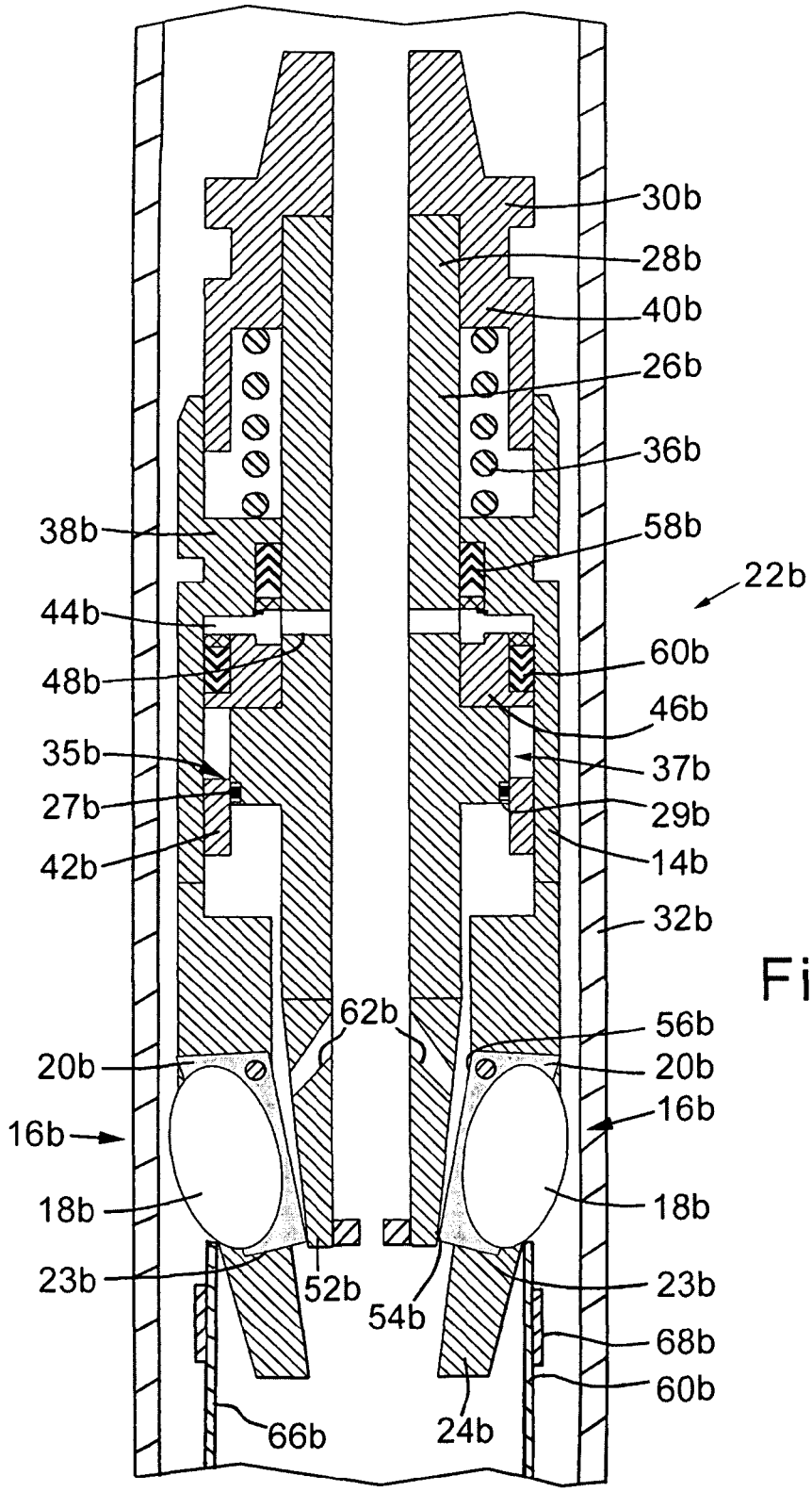
FIG. 9 is a view of the expansion tool of FIG. 7, shown in the deactivated configuration in alternative tubing to be expanded.
Figure 10:
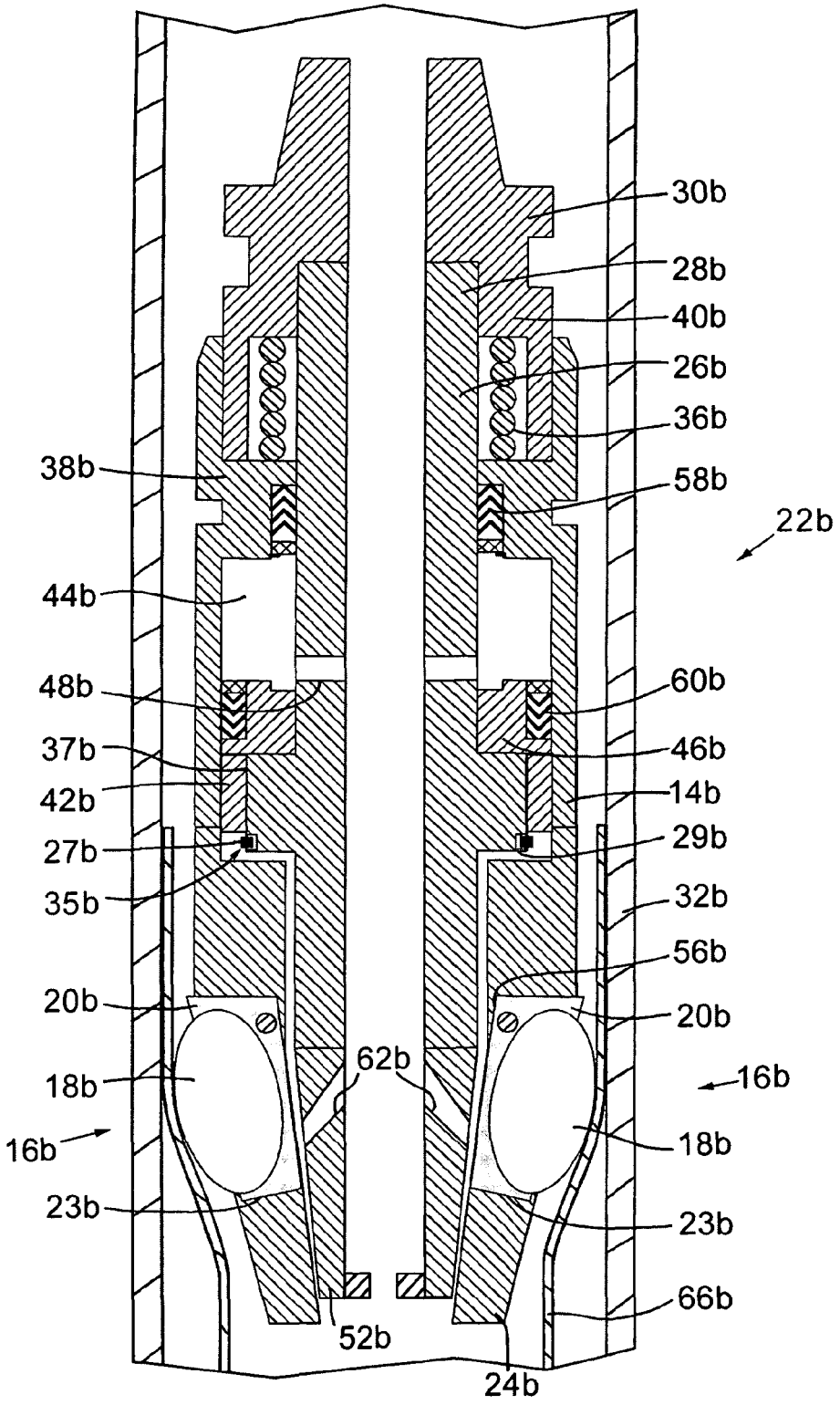
FIG. 10 is a view of the expansion tool of FIG. 9 in the expanded configuration, drawn to a larger scale and shown during expansion of the tubing.

Turning now to FIGS. 9 and 10, an alternative method of operation of the tool 22*b* will be described.

FIG. 9 shows the tool 22*b* located in borehole casing 32*b*, in the deactivated position. The tool 22*b* has been run into the casing 32*b* on a string together with expandable bore-lining tubing in the form of an expandable liner 66*b*. An upper end of the liner 66*b* is shown in FIG. 9, and is located overlapping the casing 32*b*, with a seal sleeve 68*b* provided on an outer surface of the liner 66*b*, for sealing between the casing 32*b* and the liner 66*b*.

When the liner 66*b* has been located in the desired position, the tool 22*b* is set down on the upper end of the liner 66*b* and weight is applied to the mandrel 26*b*, through the connecting sub 30*b*. This moves the mandrel 26*b* downwardly, forcing the rollers 18*b* outwardly to the expanded configuration, and the snap ring 27*b* locks the mandrel in the activating position and thus the rollers 18*b* in the extended configuration. The tool 22*b* is then rotated and advanced axially through the liner 66*b*, diametrically expanding the liner into contact with the casing 32*b* as shown in FIG. 10 (in combination with a mandrel, as described above). The tool 22*b* is advanced through the liner 66*b* to a desired depth, and then recovered to surface, as described above. The liner 66*b* is thus hung from the casing 32*b* and sealed relative to the casing by the seal sleeve 68*b*.

Figure 11:
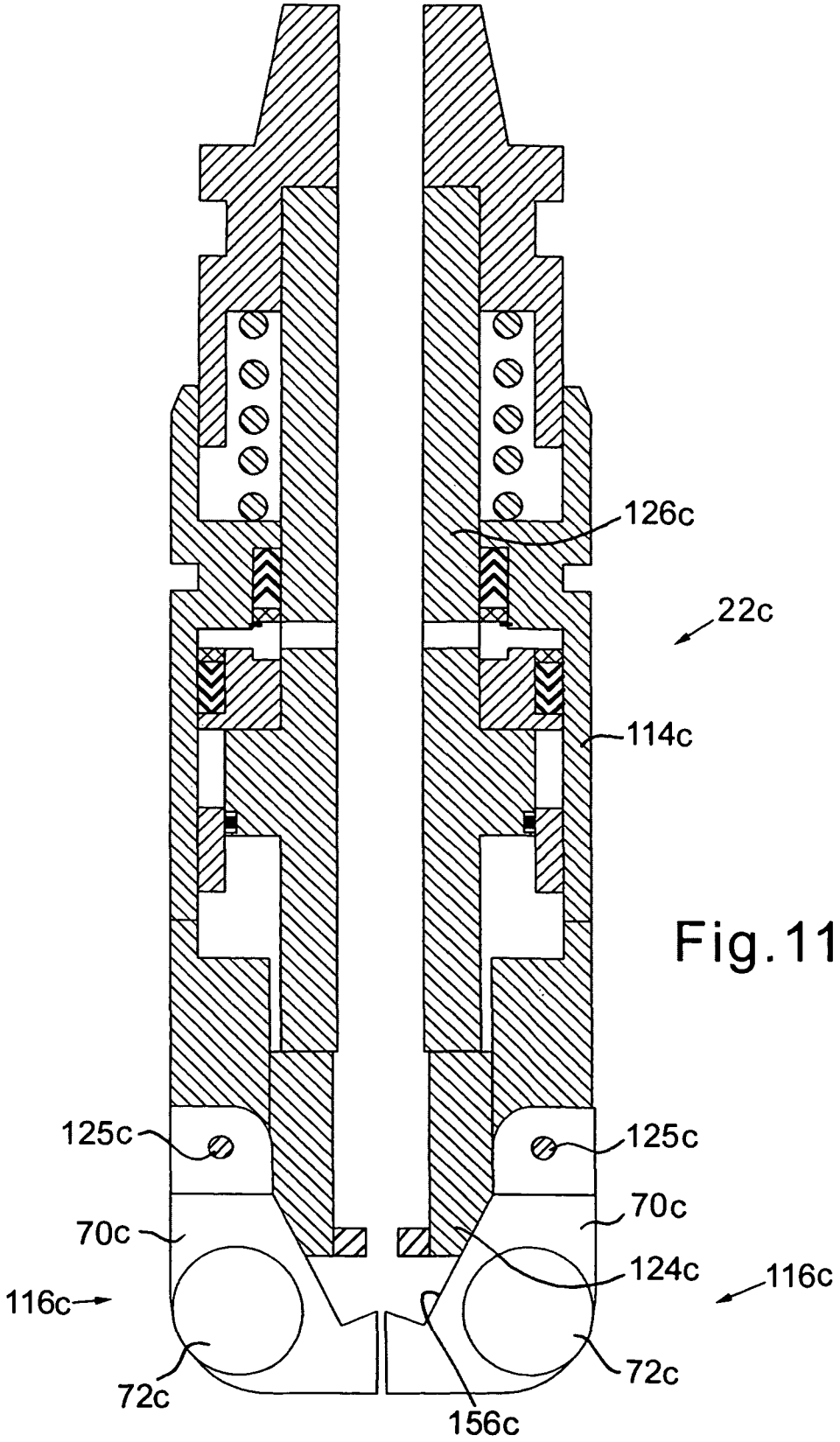
FIG. 11 is a longitudinal sectional view of an expansion tool forming part of any one of the expansion devices of FIGS. 1 to 5E, in accordance with a further alternative embodiment of the present invention, the tool shown in a deactivated configuration.
Figure 12:
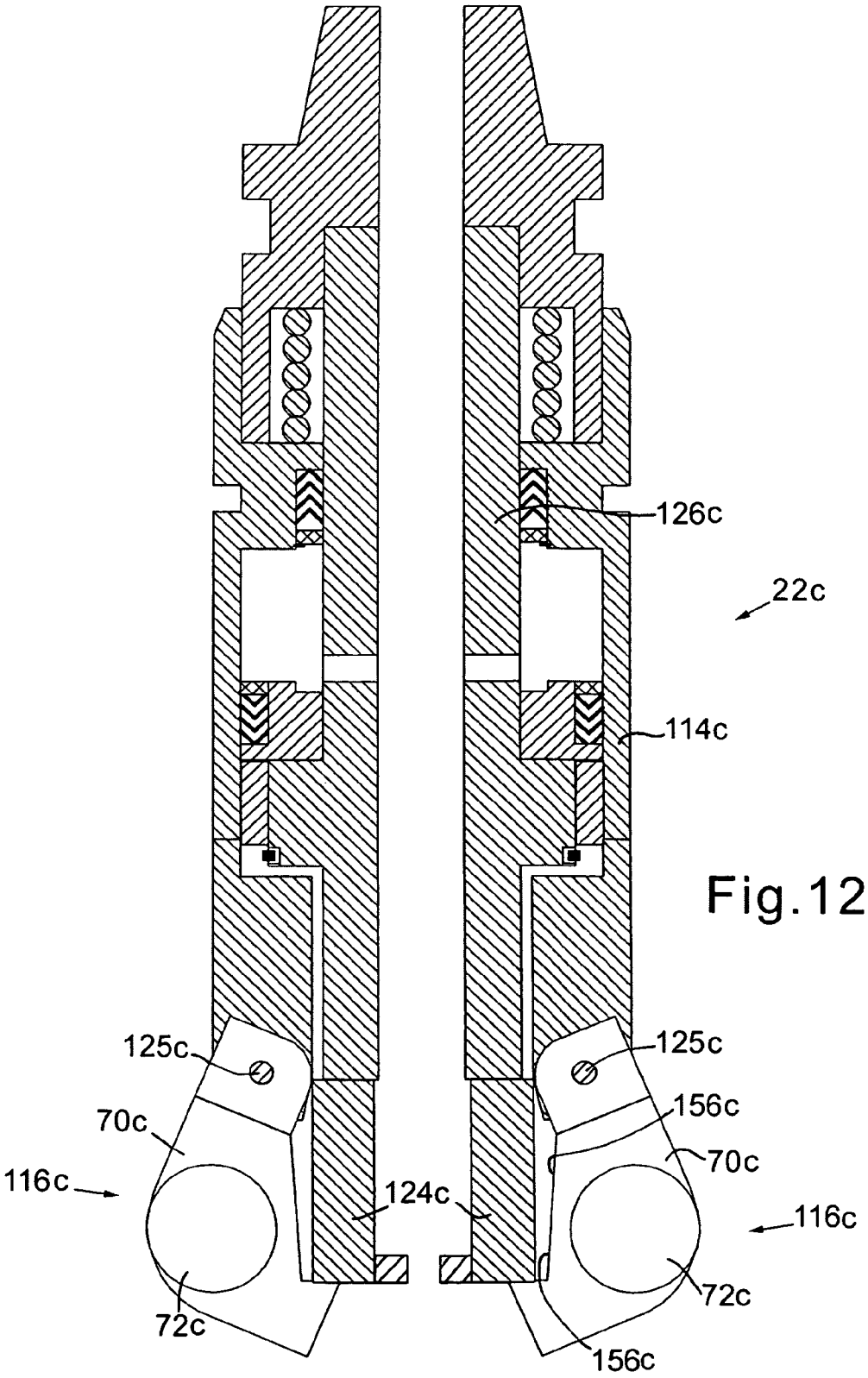
FIG. 12 is a view of the expansion tool of FIG. 11, drawn to a larger scale and shown in an expanded configuration.

Turning now to FIG. 11 there is shown a further alternative tubing expansion tool 22*c*. Like components of the tool 22*c* with the tool 22*b* of FIG. 7 share the same reference numerals incremented by 100. For ease of reference, only the significant differences between the structure of the tool 22*c* with respect to the tool 22*b* will be described herein.

The tool 22*c* includes three expansion member assemblies 116*c*, each comprising expansion arms 70*c* coupled to the tool body 114*c* by pivots 125*c* and an expansion ball 72*c* rotatably mounted to the arm 70*c* for expanding tubing. The arms 70*c* are spaced 1200 apart and are moveable about the pivots 125*c* between the de-activated configuration of FIG. 11 and the expanded configuration of FIG. 12 in the same fashion as the tool 22*b*. The mandrel 126*c* includes a cylindrical lower end 124*c* and each arm 70*c* includes an inner surface 156*c* which is recessed (not shown) to define a cam surface which abuts the mandrel lower end 124*c*. As the mandrel 126*c* descends, the mandrel urges the arms 70*c*, and thus the expansion balls 72*c*, outwardly to the expanded configuration of FIG. 12. Pivotably mounting the arms 70*c* on the body 114*c* in this fashion allows a high expansion ratio of the tubing as there is a relatively large movement of the expansion balls 72*c* between the de-activated and expanded configurations.

Figure 13:
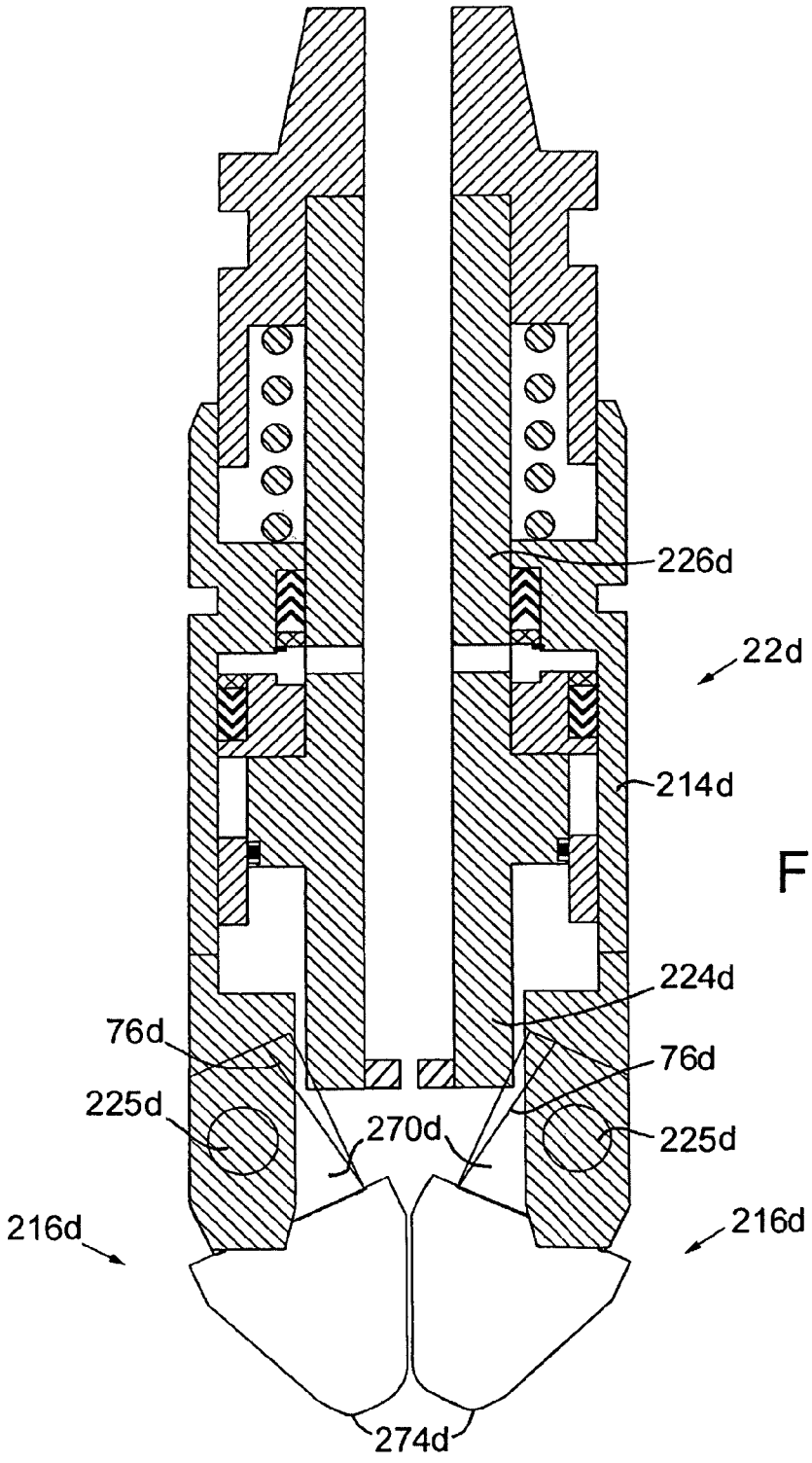
FIG. 13 is a longitudinal sectional view of an expansion tool forming part of any one of the expansion devices of FIGS. 1 to 5E, in accordance with a further alternative embodiment of the present invention, the tool shown in a deactivated configuration.
Figure 14:
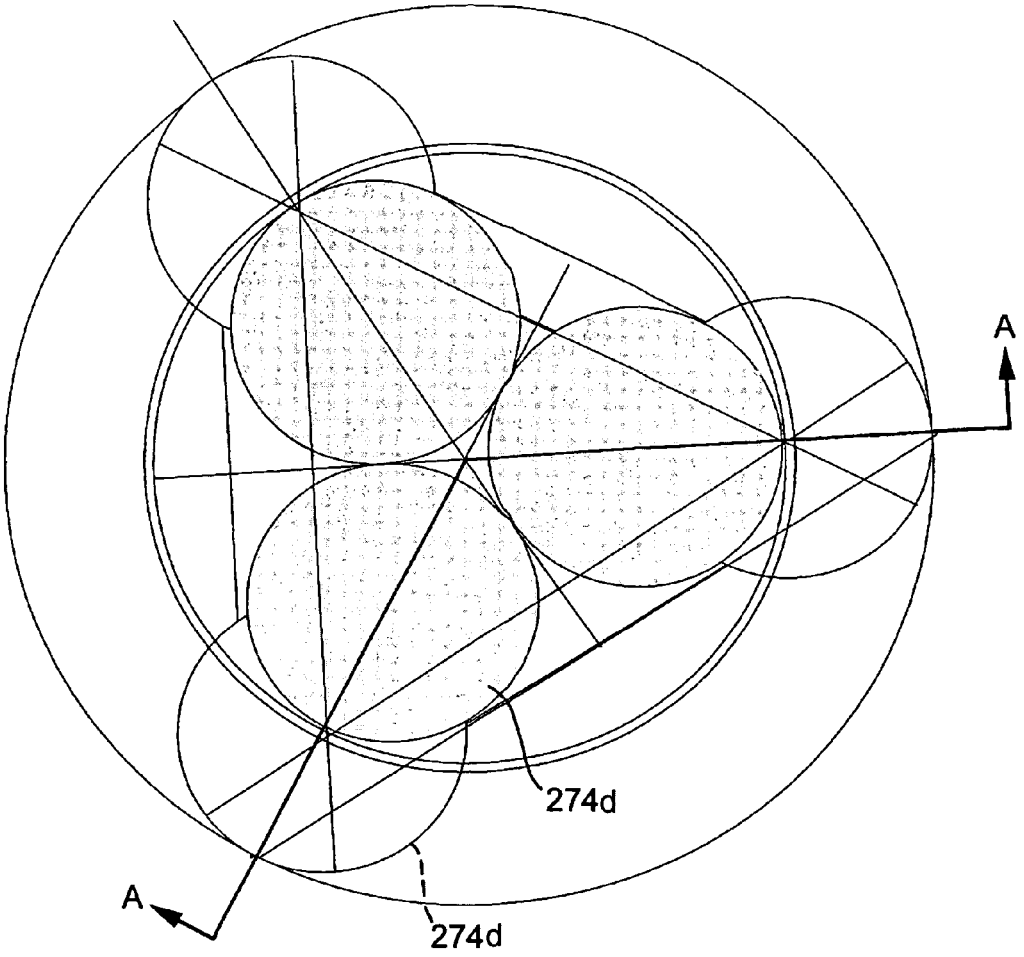
FIG. 14 is a schematic, bottom view of the expansion tool of FIG. 13 showing expansion members of the tool in both the de-activated and the expanded configurations.
Figure 15:
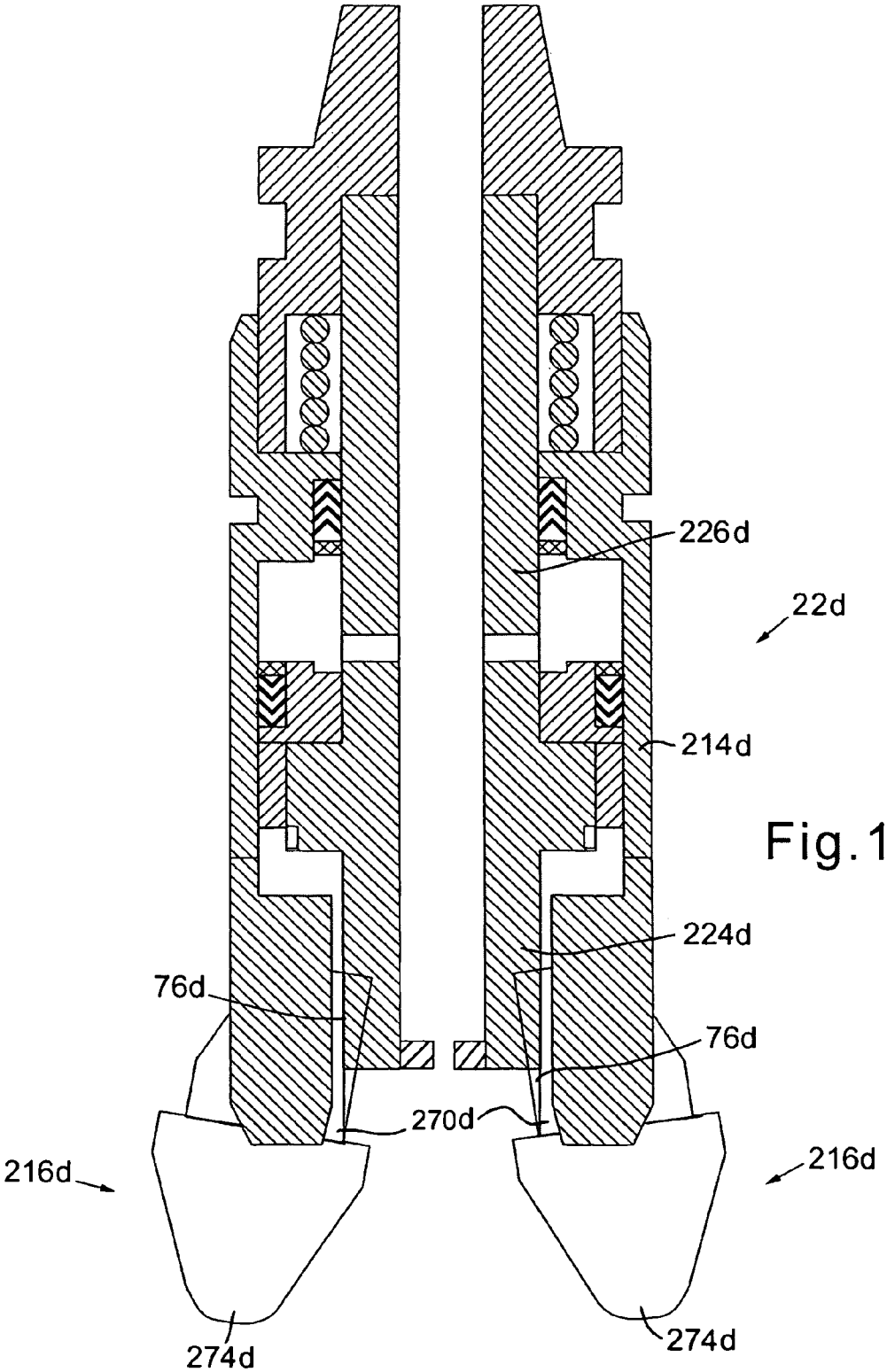
FIG. 15 is a view of the tubing expansion tool of FIG. 13, drawn to a larger scale and shown in an expanded configuration.

Turning now to FIG. 13, there is shown a yet further alternative tubing expansion tool 22*d*. This view of the tool 22*d* corresponds to a section along line A-A of FIG. 14. It will be understood that the view of the tool 22*c* shown in FIG. 11 is sectioned in a similar fashion.

Like components of the tool 22*d* with the tool 22*b* of FIG. 7 share the same reference numbers incremented by 200. Again, only the main differences between the tool 22*d* and the tool 22*b* will be described herein.

The tool 22*d* includes three expansion members 216*d* spaced 1200 apart and including expansion arms 270*d* pivotably mounted to the tool body 214*d* by pivots 225*d*. Tapered, truncated expansion cones 274*d* are rotatably mounted on spindles of the arms 270*d* for expanding tubing when the tool is moved to the expanded configuration of FIG. 15. Again, a high expansion ratio is achieved by the relatively large movement of the expansion members 216*d*, as shown best in FIG. 14, the position of the cones 274*d* in the expanded configuration indicated by the broken reference line. The tool 22*d* is otherwise similar to the tool 22*c* of FIG. 11 and cam surfaces 76*d* defined by the arms 270*d* are illustrated in FIG. 13. These cam surfaces 76*d* abut the lower end 224*d* of the tool mandrel 226*d* during downward movement of the mandrel, to urge the expansion arms 270*d* outwardly to the expanded configuration.

In further embodiments, the tools 22*b*, 22*c* or 22*d* may be activated through a combination of mechanical force applied to the respective tool mandrel and through circulation of fluid through the tool bore to force the mandrel downwardly.

In alternative embodiments of the present invention (not illustrated), an expansion device may be provided incorporating a hoop stress inducing expansion tool of the type disclosed in the applicant's International patent application no. PCT/GB2002/005387, the disclosure of which is incorporated herein by way of reference. PCT/GB2002/005387 discloses expansion tools of the type adapted to be advanced through tubing without rotation, having a number of expansion rollers (some compliantly mounted) located with their respective axes perpendicular to a main axis of the tool. PCT/GB2002/005387 also discloses a hoop stress inducing expansion tool in the form of a compliant cone or mandrel, and expansion arms or fingers, which may be employed in the present invention.

Figure 16:
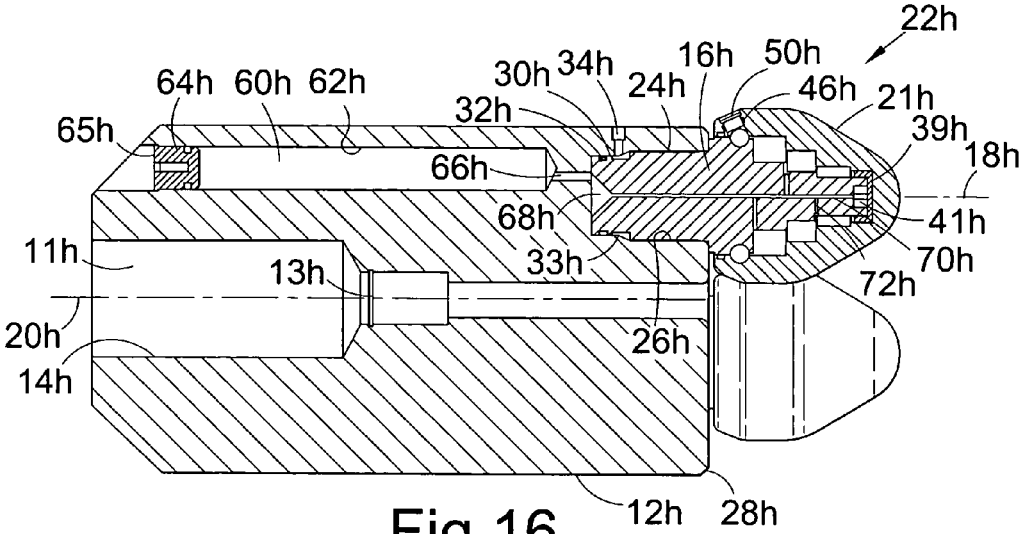
FIG. 16 is a sectional view of an expansion tool forming part of any one of the expansion devices of FIGS. 1 to 5E, in accordance with a further alternative embodiment of the present invention.

Reference is now made to FIG. 16 of the drawings, which shows a sectional view of a still further alternative expansion tool 22*h*. The tool 22*h* comprises a generally cylindrical body 12*h* (in this example, 197.10 mm outer diameter), the trailing end of the body 12*h* defining a box connection 14*h* for coupling to a corresponding pin connection provided on the lower end of a string of drill pipe (not shown), cone, mandrel or the like, as described above. The body 12*h* defines a throughbore 11*h*, to allow fluid to be passed through the tool 22*h*, the throughbore 11*h* including a recess 13*h* to accommodate a flow-restricting nozzle if required.

Figure 17:
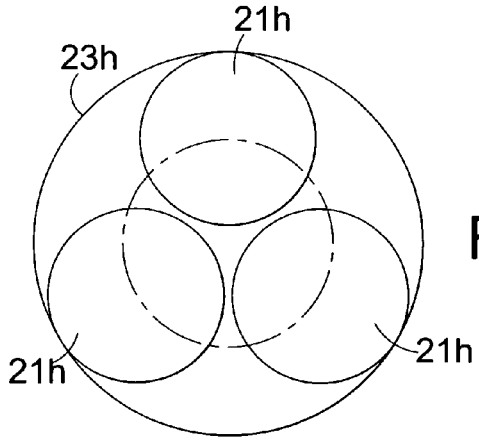
FIG. 17 is an end view of the tool of FIG. 16, showing the diameters described by the expansion members.
Figure 18:
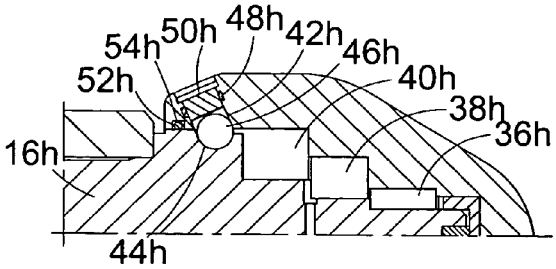
FIG. 18 is an enlarged sectional view showing details of the bearing arrangement between an expansion member and a spindle of the tool of FIG. 16.

Mounted on the leading end of the body 12*h* are three spindles 16*h* (only one shown), the spindle axes 18*h* lying parallel to the main body axis 20*h*. Each spindle 16*h* provides mounting for a respective expansion member in the form of a 30 degree conical profile 21*h*. In this example the profiles 21*h* describe a maximum diameter 23*h* of 220 mm, as illustrated in FIG. 17. The spindles 16*h* are essentially identical to one another and thus only the spindle 16*h* illustrated in section in FIGS. 16 and 18 of the drawings will be described in detail.

The spindle 16*h* has a male threaded portion 24*h* which is received in a complementary female threaded bore 26*h* in the body end face 28*h*. The end of the spindle threaded portion also features a groove 30*h* housing an O-ring seal 32*h*, and an annular slot 33*h* for cooperation with a pin 34*h* which serves to further secure the spindle 20*h* to the body 12*h*. The leading end of the spindle, as illustrated in greater detail in FIG. 18 of the drawings, has a stepped profile and cooperates with a number of bearings to provide mounting for the conical profile 21*h*. Three journal bearings 36*h*, 38*h*, 40*h* are provided between the spindle 16*h* and the profile 21*h*, which is stepped internally in a corresponding manner, as may be seen from FIG. 18 of the drawings. In particular, the bearings comprise a needle roller bearing 36*h*, a roller thrust bearing 38*h*, and a taper roller bearing 40*h*. The free end of the spindle 16*h* is capped by a brass thrust cap 39*h* which sits upon a hexagonal wear insert 41*h* located in a corresponding recess in the end face of the spindle, and which insert wears preferentially to the spindle. Furthermore, each of the spindle 16*h* and the profile 21*h* define a respective bearing race 42*h*, 44*h*, into which an appropriate number of balls 46*h* are located via a port 48*h* in the profile 21*h*, and which port 48*h* may be closed by a plug 50*h* held in position by a circlip.

The base of the profile 21*h* defines a groove 52*h* accommodating an O-ring seal 54*h* which serves to retain lubricant in the bearing area and also to prevent ingress of material. Lubricant for the bearings is retained within a sealed pressure-compensated system including a lubricant reservoir 60*h*, one reservoir 60*h* being provided for each profile 21*h*. The reservoir 60*h* is provided by the leading end of a longitudinally extending bore 62*h* which has been drilled from the trailing end of the body 12*h*, a piston 64*h* being movable within the bore 62*h* in response to external fluid pressure, and the piston being retained in the bore 62*h* by a circlip 65*h*. A conduit 66*h* extends from the reservoir 60*h* to the base of the spindle 16*h*. A conical recess 68*h* in the base of the spindle 16*h* in communication with the conduit 66*h* leads to a bore 70*h* extending along the spindle axis 18*h*, with branches 72*h* extending radially from the bore 70*h* to carry lubricant to the base of the journal bearing seats.

One face of the piston 64*h* is exposed to external pressure, while the other face of the piston is in contact with the lubricant in the reservoir. Thus, the piston 64*h* may move in the bore 62*h* to compensate for changes in external pressure, in particular the increasing pressure experienced as the tool 22*h* is lowered into a bore. This minimizes the pressure differentials experienced by the seals 54*h*, thus increasing seal life.

In use, the tool 22*h* is provided as part of an expansion device such as device 10 of FIG. 1, mounted to the lower end of a string of drill pipe and run into a bore. The device carrying the tool 22*h* may be run into the bore together with a tubular to be expanded, or may be run into a tubular which has been previously located in the bore. The leading end of the profiles 21*h* are located in the upper end of the tubular, while the tool 22*h* is rotated and axial force is applied to the tool. As the tool 22*h* rotates, the profiles 23*h* are rolled around the inner face of the tubular, and tend to reduce the wall thickness of the tubular such that the diameter of the tubular increases. As the tool 22*h* translates axially, the tubular is expanded to a diameter similar to the maximum diameter described by the profiles 21*h*.

The rotary expansion of downhole tubulars, and in particular solid walled tubulars, subjects expansion tools to significant radial, axial and torsional loads. Furthermore, the expansion of the tubing tends to produce elevated temperatures, both in the tubing and the expansion tool. The provision of the combination of journal and roller bearings within a sealed lubrication system facilitates the free rolling motion necessary to achieve the desired uniform tubular expansion while minimizing induced torque and friction, and hence increased temperature. The tool construction provides a compact and robust arrangement well adapted to withstand the loads experienced in use, and the provision of a pressure-compensated bearing lubrication system reduces the pressure differential across the bearing seals and thus extends seal life. This increases bearing life and thus facilitates use of the tool 22*h* in the expansion of extended lengths of tubing downhole.

In addition, those of skill in the art will appreciate that the present tool configuration combines the robustness and uniform expansion of fixed geometry expansion devices with the advantages of the reduced torques and loads required for operation of a rotary expansion device.

Figure 19:
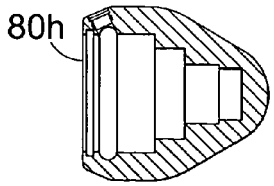
FIG. 19 is a sectional view of an alternative expansion member for the tool of FIG. 16.
Figure 20:
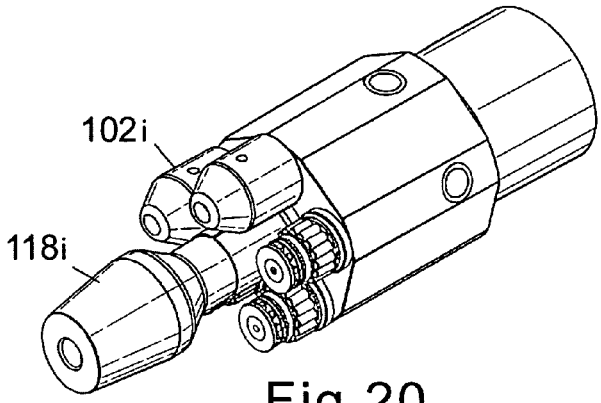
FIG. 20 is a perspective view of an expansion tool forming part of any one of the expansion devices of FIGS. 1 to 5E, in accordance with a further alternative embodiment of the present invention, with three of the five expansion members removed.
Figure 21:
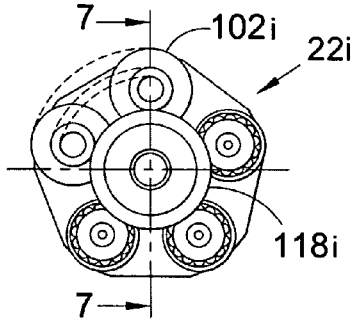
FIG. 21 is a front view of the tool of FIG. 20.
Figure 22:
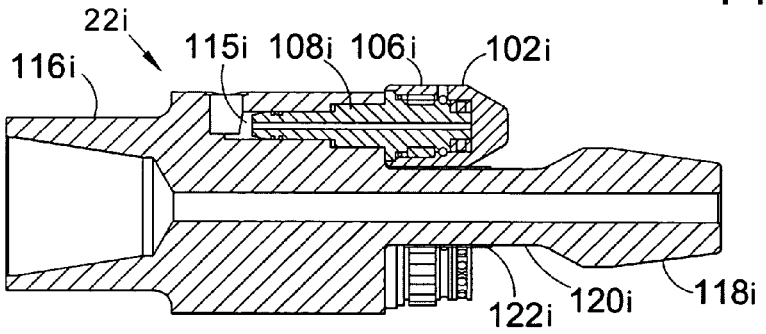
FIG. 22 is a sectional view on line 7-7 of FIG. 21.
Figure 23:
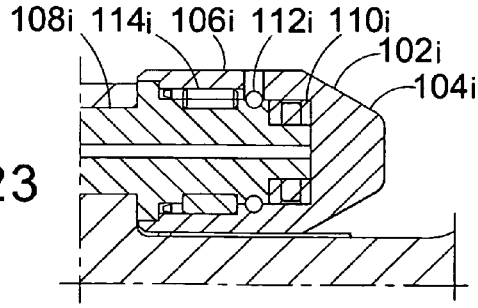
FIG. 23 is an enlarged view of a portion of FIG. 22.

The above embodiment features 30 degree angle profiles, however FIG. 19 of the drawings illustrates a profile 80*h* with a 20 degree angle, which will tend to induce a more gradual expansion.

Reference is now made to FIGS. 20 to 23 of the drawings, which illustrate a still further alternative expansion tool 22*i*. The tool 22*i* includes five expansion members 102*i*, each including a tapering leading end portion 104*i* and a cylindrical trailing portion 106*i*. The spindles 108*i* on which the members 102*i* are mounted are each profiled to accommodate a thrust bearing 110*i*, a roller bearing 112*i* and a journal bearing 114*i*. Although the seals are not illustrated, the tool 22*i* incorporates a sealed lubrication system, including a lubrication reservoir 115*i*.

The tool body 116*i* has a central portion which extends beyond the expansion members 102*i* and terminates in a pin connection 118*i* for coupling to a further part of a tool string, mandrel or the like. Rearwardly of the connection 118*i* is a cylindrical body portion 120*i* about which is mounted a contact sleeve 122*i* of low friction material such as PTFE. The sleeve 122*i* is in contact with the cylindrical portions 106*i* of the expansion members, and thus provides radial support for the members 102*i*.

The tool 22*i* is operated in substantially the same manner as the tool 22*h* described above, but of course does not form the end of the tool string; other tools and devices will be mounted forwardly of the tool 100*i*, and which may include other expansion tools, as described above.

Figure 24:
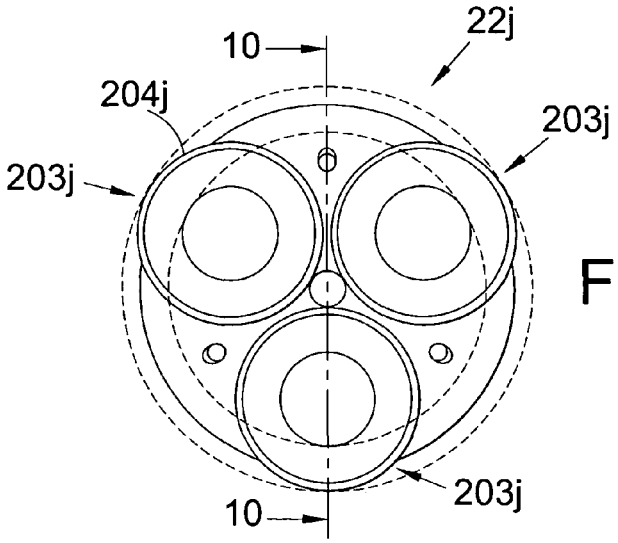
FIG. 24 is an end view of an expansion tool forming part of any one of the expansion devices of FIGS. 1 to 5E, in accordance with a further alternative embodiment of the present invention.
Figure 25:
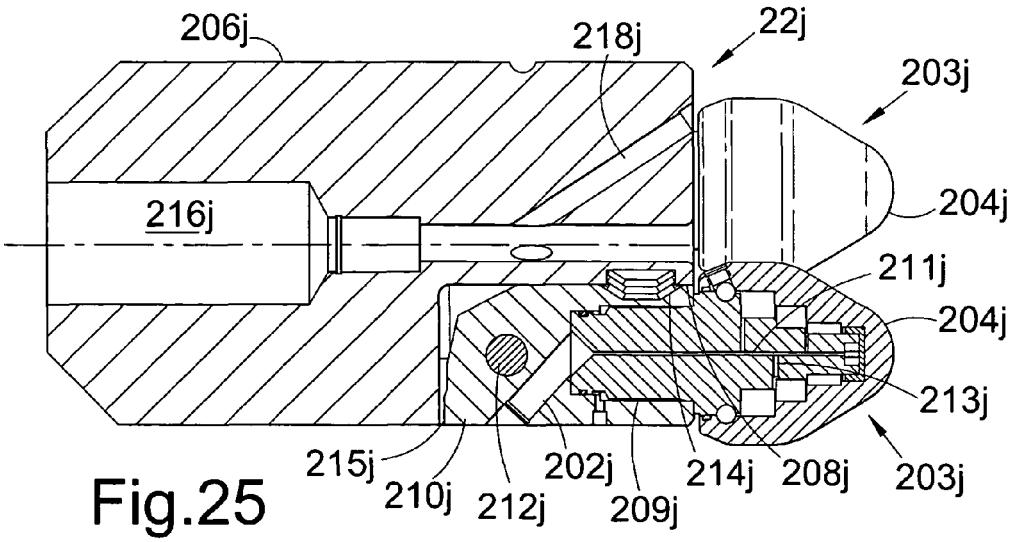
FIG. 25 is a sectional view on line 10-10 of FIG. 24.
Figure 26:
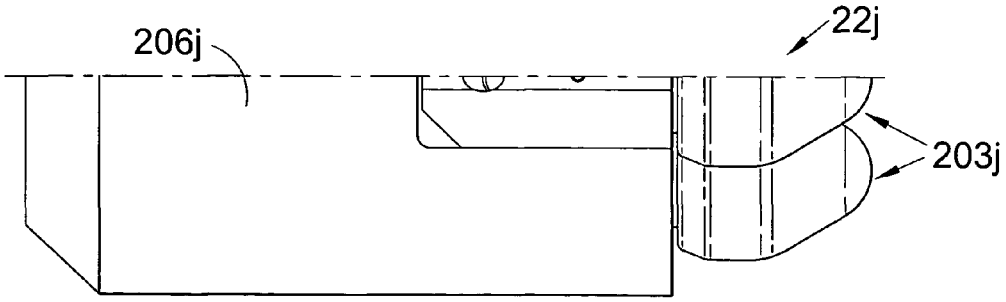
FIG. 26 is a side view showing one half of the tool of FIG. 24.
Figure 27:
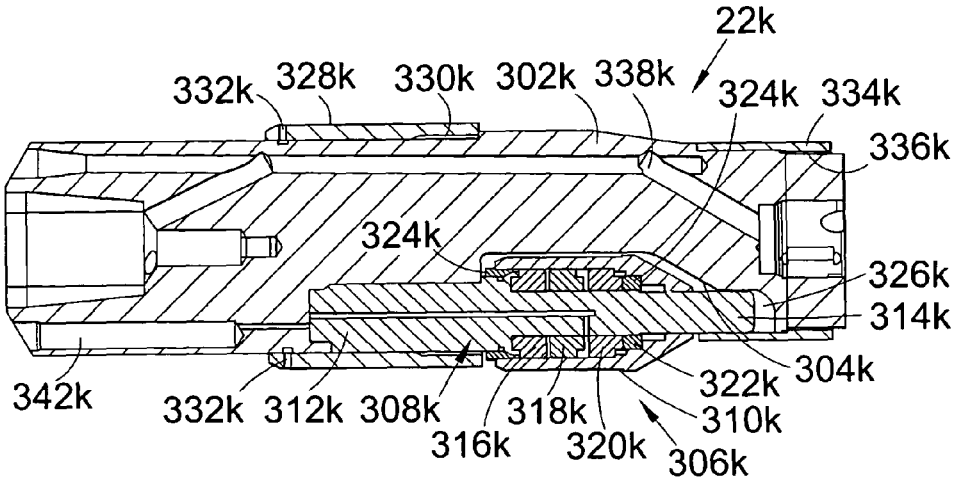
FIG. 27 is a sectional view of an expansion tool forming part of any one of the expansion devices of FIGS. 1 to 5E, in accordance with a further alternative embodiment of the present invention.

Reference is now made to FIGS. 24 to 26, which show a still further alternative expansion tool 22*j*. The tool 22*j* shares many features with the tool 22*h* described above, including a sealed lubrication system having a lubricant reservoir 202*j* featuring a pressure-compensating piston (not shown). However, the tool 22*j* includes three tubing expansion modules 203*j* mounted in the tool body 206*j*. Each module 203*j* includes a spindle 209*j* and an expansion member in the form of a conical profile or cone 204*j*. As will be described below, providing an expansion tool with tubing expansion modules allows for quick replacement of any one of the modules in the operational environment.

Also, unlike the fixed diameter tools 22*h*, 22*i*, this tool 22*j* is compliant, in that the modules 203*j* including the rotary expansion profiles or cones 204*j* are mounted to the tool body 206*j* such that the cones 204*j* may be individually moved radially inwardly to a limited extent to describe a smaller diameter. This is useful to accommodate, for example, incompressible bore restrictions which prevent the tubing being expanded to a preferred diameter, or variations in tubing wall thickness.

The tool 22*j* is illustrated with the cones 204*j* in the minimum gauge position, hard against respective stops 208*j* on the body 206*j*. The cones 204*j* are each mounted to the spindle 209*j* which is threaded and pinned in a housing 210*j*, each housing 210*j* being pivotally mounted to the body 206*j*, via respective pins 212*j*. The pins 212*j* thus couple the modules 203*j* to the body 206*j* and allow the modules to be released from the body, if required. The clearance between the sides of each housing 210*j* and the slots in the body 206*j* which accommodate the housings 210*j* is minimized to ensure that the pins 212*j* experience only shear, and not bending forces. The degree of compliancy is provided by locating a spring, in this example a stack of three disc springs 214*j*, between the body 206*j* and each housing 210*j*, the degree of outward rotation of the housings being limited by the provision of appropriate stops 215*j*.

As with the other tools 22*h*, 22*i*, this tool 22*j* defines a central through bore 216*j* to allow passage of fluid through the tool body 206*j*. In addition, three bores 218*j* branch off from the central bore 216*j* such that, in use, a cooling jet of liquid may be directed onto the portion of tubing undergoing expansion.

The sealed lubrication system of the tool 22*j*, whilst similar in operation to that of the tool 22*h*, differs in that the lubrication system is provided as an integral part of each tubing expansion module 203*j*. In more detail, the lubrication system includes a lubrication reservoir 202*j* in each of the modules 203*j*. The reservoirs 202*j* each comprise cylinders formed in the spindle 209*j* of the respective modules, with a bore 211*j* extending through the spindle 209*j* and branches 213*j* extending radially from the bore 211*j* to the bearing seats. A piston is mounted in each cylinder 202*j* to pressure compensate for changes in external pressure.

In variations in the structure of the tool 22*j*, the disc springs 214*j* may be replaced by radially mounted or angled pistons (not shown) in the tool body 206*j*, for urging the tubing expansion modules 203*j* outwardly in use, to pivot about the pins 212*j*. The modules 203*j* are thus radially inwardly movable against the pistons, in use, to provide a degree of compliancy in the tool. The pistons may be urged radially outwardly on flow of fluid through the tool or supply of fluid in a closed system to the piston.

Reference is now made to FIGS. 27 to 30 which show a still further alternative expansion tool 22*k*. The expansion tool 22*k* shares many features with the tool 22*h* described above, including a sealed lubrication system and bores for allowing the passage of cooling fluid through the tool.

Figure 28:
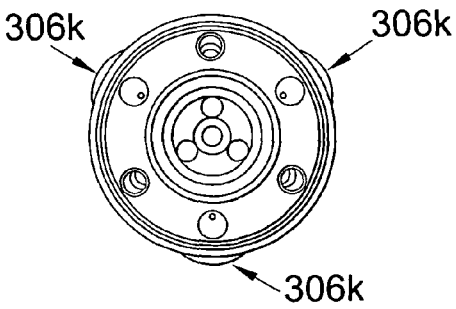
FIGS. 28 and 29 are top and bottom views of the expansion tool of FIG. 27, respectively.

In more detail, the tool 22*k* includes a generally cylindrical body 302*k* with three recesses 304*k* in the outer surface of the body 302*k*, in which three corresponding tubing expansion modules 306*k* are mounted. The top and bottom views of FIGS. 28 and 29 show the relative location of the modules 306*k*, which are spaced apart by 120 degrees.

Each of the modules 306*k* includes a spindle 308*k* and an expansion member in the form of a conical profile 310*k* rotatably mounted on the spindle 308*k*. The profile 310*k* has a leading end defining a 30 degree angle. The recesses 304*k* in the body 302*k* are shaped to receive the spindles 308*k*, which include a rear end in the form of a curved plate 312*k* with a cylindrical spindle shaft 314*k* extending from the plate 312*k*. The plate 312*k* includes a number of mounting holes which receive fixing bolts (not shown) for coupling the spindle 308*k* to the body 302*k*. The conical profile 310*k* is mounted on the cylindrical shaft 314*k* with a series of journal bearings 316*k*, 318*k* and 320*k* between the conical profile 310*k* and the shaft 314*k*, the bearings held axially by lock nuts 322*k*, 324*k*. Each module 306*k* includes a lubrication system similar to that described above with reference to the tool 22*h*. A lower end 326*k* of the recess 304*k* receives the end of the shaft 314*k* for locating the module 306*k* in the body 302*k*.

After the spindles 308*k* have been secured in the respective recesses 304*k* by the fixing bolts, a first restraint sleeve 328*k* is coupled to the body 302*k* by a co-operating threaded joint 330*k* and set screws 332*k* are located to secure the sleeve 328*k* against rotation. In addition, a second restraint sleeve 334*k* is coupled to the body 304*k* by a co-operating threaded joint 336*k*, to secure the end of the cylindrical shaft 314*k* in the lower end 326*k* of the recess 304*k*. The spindles 308*k* are then securely coupled to the body 302*k* with the conical profile 310*k* rotatable about the spindle ready for use in expanding tubing.

Figure 29:
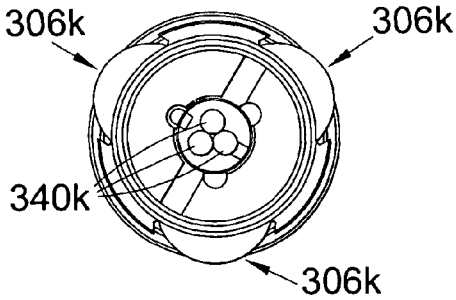
Figure 30:
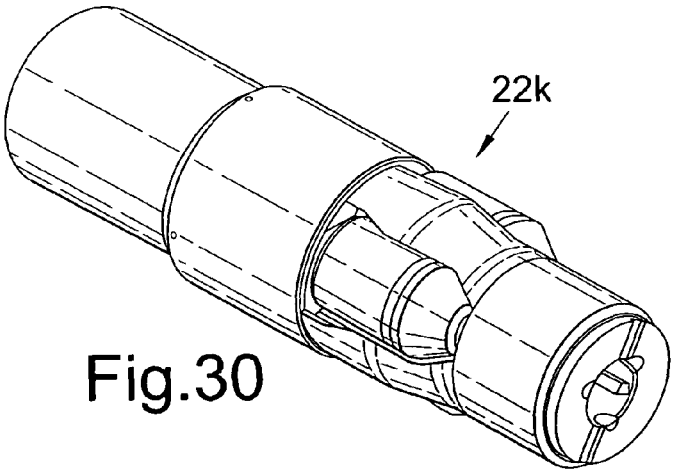
FIG. 30 is a perspective view of the expansion tool of FIG. 27.

The body 302*k* also includes three bores 338*k* which extend through the body and having outlets 340*k*, as best shown in FIG. 29. The bores 308*k* allow cooling fluid to flow to the tubing during expansion.

The tool lubrication system is similar to that described with reference to the tool 22*h*, and a conduit 342*k* of the lubrication system is coupled to the bearing lubrication system and pressure compensated by a piston or diaphragm.

Provision of the tool 22*k* including the tubing expansion modules 306*k* allows for quick replacement of any one of the modules 306*k* in the operational environment should any of the spindles 308*k*, conical profiles 310*k* or the bearings 316*k* to 320*k* require replacement or maintenance. In particular, it is not required to disassemble the entire tool to remove the modules 306*k*, nor to remove the conical profile 310*k* from the spindle 308*k* during removal. Instead, to release the modules 306*k*, the restraint sleeves 328*k* and 334*k* are released before removing the fixing bolts connecting the spindles 308*k* to the body 302*k*. The module 306*k* may then be removed and replaced as necessary. This both cuts down on the time and therefore operating costs of using the tool 300*k* and provides flexibility in use, as the procedure can be carried out in the operational environment, such as on the rig floor. Alternatively, the tool 300*k* may be broken-out (released) from a string carrying the tool for subsequent removal of the modules 306*k* in, for example, a workshop environment.

In variations in the structure of the tool 22*k*, the tubing expansion modules 306*k* may be radially movably mounted (not shown) with respect to the tool body 302*k*, to provide the tool 22*k* with a degree of compliancy. For example, the modules 306*k* may be coupled to or may define a radially movable piston, the piston urged radially outwardly, in use, on flow of fluid through the tool or supply of fluid in a closed system to the piston.

It will be understood that features of any one of the expansion tools of FIGS. 6 to 30 may be provided in combination in alternative expansion devices.

Various modifications may be made to the foregoing without departing from the spirit and scope of the present invention.

For example, any one of the expansion tools of FIGS. 7 to 15 may only include locking means or biasing means. The tool may be mechanically activated in any alternative fashion suitable for moving the mandrel down relative to the body. For example, the tool mandrel may be urged downwardly relative to the tool body by restraining the body and setting weight down on the mandrel.

The snap ring may alternatively be disengaged downhole, such that the biasing spring returns the sub and mandrel to the de-activated position. This de-supports the rollers, which are now no longer able to exert an expansion force on the tubing, allowing the expansion tool to be returned to surface more easily. The snap ring may be released downhole by a release assembly such as release sleeve moved over the snap ring to cam the ring into the ring slot, allowing movement of the mandrel past the guide ring. Alternatively, the tool may include dogs or pins for moving the snap ring inwardly. In a further alternative, the snap ring may simply be sheared out.

The mandrel may define a piston in place of a floating annular piston mounted on a shoulder of the mandrel, the mandrel shoulder may define the piston. Thus, for example, the annular piston of the tool may comprise an integral part of or may be coupled to the mandrel shoulder.

The tool may be run on jointed tubing and may be driven from surface by a kelly or top drive.

Where the expansion members of the tool are mounted on pivots, movement of the mandrel downwardly may rotate the rollers about the pivot such that the rollers describe an expanded diameter for expanding tubing.

Where the tools are activated by fluid pressure, the respective tool mandrel may be urged downwardly either by providing the mandrel with a restriction nozzle to create a back pressure, or by defining a differential piston area across the floating annular piston, or by a combination of the two, as described above.

In further alternatives, the tubing expansion modules of any one of the expansion tools of FIGS. 16 to 30 may be located at an angle to a main axis of the tubing expansion tool and may be angled towards a leading or lower end of the tool.

The lubrication system may be provided with a lubrication fluid reservoir internally or externally of the tool and pressure compensated in any desired fashion such as by piston, diaphragm or the like. The arrangement of bearings in the tools may be any desired combination and may be tailored to the particular expansion procedure to be conducted. The spindles may be releasably coupled to the tool body using any suitable fixings such as screws, shear pins or the like. Whilst some of the above embodiments utilize cantilevered spindles, in other aspects of the invention spindles supported at both ends may be utilized.

Additionally or alternatively, the expansion member module, and thus the expansion member may be skewed with respect to the main axis of the tool and may, for example, be generally helically oriented. Thus, the expansion member axis may extend at an angle with respect to the tool main axis. Mounting the expansion member skewed with respect to the tool axis causes the expansion member to exert a force on the tool body tending to advance the tool body through tubing being expanded on rotation of the tool body.

The lubrication system may be adapted to be pressurized such that fluid in the lubrication system is under a higher pressure than fluid outside the system. Such overpressurising of the lubrication system promotes a positive displacement of the lubrication fluid from the system, in use, to prevent ingress of well fluids, solids or other contaminants into the lubrication system. The lubrication system may include a biased piston, for example, a spring biased piston or the like for pressurizing the lubrication system fluid above the pressure of fluid outside the system.

The expansion members/modules may be at irregular angular spacings with respect to the tool body, if desired.

The invention claimed is:

1. A tubing expansion device comprising:

at least one expansion member adapted to expand a tubing by inducing a hoop stress in the tubing; and at least one further expansion member adapted to expand the tubing by inducing a compressive yield of the tubing, wherein one of said at least one expansion member and said at least one further expansion member is adapted to expand the tubing to a first diameter and the other of said at least one expansion member and said at least one further expansion member is adapted to further expand the tubing to a larger second diameter, wherein the device is arranged such that expansion of the tubing to a desired final diameter is carried out using the hoop stress inducing expansion member.

2. A tubing expansion device as claimed in claim 1, wherein the expansion device is adapted to be rotated and translated through tubing to be expanded.

3. A tubing expansion device as claimed in claim 1, wherein the expansion device is adapted to be advanced through tubing to be expanded without rotation.

4. A tubing expansion device as claimed in claim 1, wherein the hoop stress and compressive yield inducing expansion members are axially spaced.

5. A tubing expansion device as claimed in claim 1, wherein the hoop stress and compressive yield inducing expansion members are circumferentially spaced.

6. A tubing expansion device as claimed in claim 1, wherein the hoop stress and compressive yield inducing expansion members are arranged according to at least one parameter of a tubing to be expanded.

7. A tubing expansion device as claimed in claim 6, wherein the parameter is selected from the group comprising: a pre-expansion diameter of the tubing; a pre-expansion wall thickness of the tubing; a desired post expansion diameter of the tubing; a desired post expansion wall thickness of the tubing; a pre-expansion strength of the tubing; Young's Modulus of the tubing material; anticipated work hardening of the tubing during expansion; a desired post-expansion strength of the tubing; and an axial length of the tubing post-expansion.

8. A tubing expansion device as claimed in claim 1, wherein the expansion members are provided spaced alternately in an axial direction.

9. A tubing expansion device as claimed in claim 1, wherein the expansion members are provided spaced alternately in a circumferential direction.

10. A tubing expansion device as claimed in claim 1, wherein said hoop stress and compressive yield inducing expansion members are provided on respective separate portions coupled together to form the expansion device.

11. A tubing expansion device as claimed in claim 10, wherein the expansion device further comprises a hoop stress inducing expansion tool and a compressive yield inducing expansion tool, each carrying said respective hoop stress and compressive yield inducing expansion members.

12. A tubing expansion device as claimed in claim 10, wherein the portions are coupled together and restrained against relative rotation.

13. A tubing expansion device as claimed in claim 10, wherein at least one of said portions is rotatable relative to at least one other portion.

14. A tubing expansion device as claimed in claim 1, wherein the hoop stress inducing expansion member is adapted to contact the tubing over a majority of a circumference of the tubing.

15. A tubing expansion device as claimed in claim 1, wherein the compressive yield inducing expansion member is adapted to contact the tubing over part of a circumference of the tubing.

16. A tubing expansion device as claimed in claim 15, wherein the compressive yield inducing expansion member is adapted to contact the tubing in a point contact.

17. A tubing expansion device as claimed in claim 15, wherein the compressive yield inducing expansion member is adapted to contact the tubing in a line contact.

18. A tubing expansion device as claimed in claim 1, wherein the at least one hoop stress inducing expansion member comprises a plurality of hoop stress inducing expansion members.

19. A tubing expansion device as claimed in claim 18, wherein said hoop stress inducing expansion members describe progressively increasing expansion diameters in a direction along an axial length of the device.

20. A tubing expansion device as claimed in claim 1, comprising a plurality of compressive yield inducing expansion members.

21. A tubing expansion device as claimed in claim 20, wherein said compressive yield inducing expansion members are arranged to describe progressively increasing expansion diameters in a direction along an axial length of the device.

22. A tubing expansion device as claimed in claim 1, comprising a plurality of hoop stress inducing expansion portions each having one of the at least one hoop stress inducing expansion member.

23. A tubing expansion device as claimed in claim 1, comprising a plurality of compressive yield inducing expansion portions each having at least one compressive yield inducing expansion member.

24. A tubing expansion device as claimed in claim 1, comprising a plurality of hoop stress inducing expansion portions each having one of the at least one hoop stress inducing expansion member, and a plurality of compressive yield inducing expansion portions each having one of the at least one compressive yield inducing expansion member, said hoop stress and compressive yield inducing expansion portions axially alternating along a length of the device.

25. A tubing expansion device as claimed in claim 1, comprising a plurality of hoop stress inducing expansion portions each having one of the at least one hoop stress inducing expansion member, and a plurality of compressive yield inducing expansion portions each having one of the at least one compressive yield inducing expansion member, wherein a plurality of said hoop stress inducing expansion portions are coupled together and joined to at least one compressive yield inducing expansion portion.

26. A tubing expansion device as claimed in claim 1, comprising a plurality of hoop stress inducing expansion portions each having one of the at least one hoop stress inducing expansion member, and a plurality of compressive yield inducing expansion portions each having one of the at least one compressive yield inducing expansion member, wherein a plurality of said compressive yield inducing expansion portions are coupled together and joined to at least one hoop stress inducing expansion portion.

27. A tubing expansion device as claimed in claim 1, comprising at least one hoop stress inducing expansion member and at least one compressive yield inducing expansion member provided on a single portion of the device.

28. A tubing expansion device as claimed in claim 1, wherein the hoop stress inducing expansion member comprises a fixed expansion member.

29. A tubing expansion device as claimed in claim 1, wherein the hoop stress inducing expansion member is fixed relative to a remainder of the device.

30. A tubing expansion device as claimed in claim 1, wherein the hoop stress inducing expansion member is formed integrally with a body of the expansion device.

31. A tubing expansion device as claimed in claim 1, wherein the hoop stress inducing expansion member is rotatable with respect to the tubing.

32. A tubing expansion device as claimed in claim 31, wherein the hoop stress inducing expansion member is rotatably mounted on a body of the device.

33. A tubing expansion device as claimed in claim 1, wherein the hoop stress inducing expansion member comprises a fixed diameter expansion member.

34. A tubing expansion device as claimed in claim 1, wherein the hoop stress inducing expansion member comprises a compliant expansion member, wherein the compliant expansion member is radially moveable inwardly in order to a position having a smaller diameter.

35. A tubing expansion device as claimed in claim 34, wherein the compliant expansion member comprises a compliant cone.

36. A tubing expansion device as claimed in claim 1, comprising a hoop stress inducing expansion tool including a plurality of hoop stress inducing expansion rollers mounted for rotation about an axis substantially perpendicular to an axis of the tool.

37. A tubing expansion device as claimed in claim 1, wherein the at least one hoops stress inducing expansion member comprises a cone with a plurality of hoop stress inducing expansion rollers rotatably mounted on the cone.

38. A tubing expansion device as claimed in claim 1, wherein the hoop stress inducing expansion member takes the form of a collapsible expansion cone which is movable between a collapse position and an expansion position, in the expansion position, the cone adapted for expanding the tubing.

39. A tubing expansion device as claimed in claim 1, wherein the compressive yield inducing expansion member comprises a rotary expansion member, which is rotatable about an expansion member axis.

40. A tubing expansion device as claimed in claim 1, wherein the compressive yield inducing expansion member is provided as part of a compressive yield inducing expansion member module releasably coupled to a body of the device as a unit.

41. A tubing expansion device as claimed in claim 40, wherein the compressive yield inducing expansion member is rotatably mounted on a spindle.

42. A tubing expansion device as claimed in claim 41, wherein the spindle is pivotally coupled to the body.

43. A tubing expansion device as claimed in claim 41, wherein an axis of the spindle is disposed at an angle with respect to a main axis of the device.

44. A tubing expansion device as claimed in claim 1, comprising a bearing between the compressive yield inducing expansion member and a body of the device, and a sealed lubrication system for containing lubricant to facilitate rotation of the compressive yield inducing expansion member relative to the body.

45. A tubing expansion device as claimed in claim 1, wherein the compressive yield inducing expansion member is radially moveably mounted with respect to a body of the device, for movement towards an expansion configuration describing an expansion diameter for expanding tubing to a predetermined diameter.

46. A tubing expansion device as claimed in claim 45, wherein the compressive yield inducing expansion member is lockable in the extended configuration.

47. A tubing expansion device as claimed in claim 45, wherein the compressive yield inducing expansion member is biased radially inwardly.

48. A tubing expansion device as claimed in claim 1, wherein the compressive yield inducing expansion member is moveable in response to applied fluid pressure.

49. A tubing expansion device as claimed in claim 1, wherein the compressive yield inducing expansion member is moveable in response to an applied mechanical force.

50. A tubing expansion device as claimed in claim 1, wherein the compressive yield inducing expansion member is radially moveable relative to a body of the device in response to both: a) an applied mechanical force; and b) an applied fluid pressure force.

51. A tubing expansion device as claimed in claim 1, wherein the compressive yield inducing expansion member is pivotally mounted with respect to a body of the device for movement towards an extended configuration.

52. A tubing expansion device as claimed in claim 1, wherein the compressive yield inducing expansion member is adapted to generate a drive force on the tubing for at least partly translating the device with respect to the tubing.

53. A tubing expansion device as claimed in claim 52, wherein the drive force is generated on rotation of the expansion device.

54. A tubing expansion device as claimed in claim 52, wherein the expansion device is adapted to be translated through the tubing by a combination of an external axial force and the generated drive force.

55. A tubing expansion device as claimed in claim 52, wherein the expansion device is adapted to be translated through the tubing without an externally applied axial force.

56. A tubing expansion device as claimed in claim 52, wherein an axis of the compressive yield expansion member is skewed with respect to a body of the device.

57. A tubing expansion device as claimed in claim 52, wherein the device comprises a plurality of compressive yield inducing expansion members, and wherein the members are circumferentially spaced and helically oriented with respect to a body of the device.

58. A tubing expansion device as claimed in claim 52, wherein the compressive yield inducing expansion member includes a gripping surface for gripping the tubing to impart a drive force on the tubing.

59. A tubing expansion device as claimed in claim 1, wherein the compressive yield inducing expansion member is adapted to expand the tubing by less than 50% of the total expansion of the tubing.

60. A tubing expansion device as claimed in claim 1, wherein the compressive yield inducing expansion member is adapted to expand the tubing by less than 25% of the total expansion of the tubing.

61. A tubing expansion device as claimed in claim 1, wherein the compressive yield inducing expansion member is adapted to expand the tubing by less than 10% of the total expansion of the tubing.

62. A tubing expansion device as claimed in claim 1, wherein at least one of the hoop stress inducing and compressive yield inducing expansion members has an expansion member axis, and wherein said axis is non-parallel with respect to a main axis of the device.

63. A tubing expansion device as claimed in claim 1, wherein the compressive yield inducing expansion member comprises a rotary expansion member, which is rotable about an expansion member axis, and wherein said axis is non-parallel with respect to a main axis of the device.

64. A tubing expansion device as claimed in claim 63, wherein said expansion member axis converges with the tool main axis towards a leading end of the device.

65. A tubing expansion device as claimed in claim 63, wherein the compressive yield inducing expansion member is rotatably mounted on a spindle, and wherein the spindle is disposed non-parallel with respect to the device main axis.

66. A tubing expansion device as claimed in claim 63, wherein the compressive yield inducing expansion member includes a spindle which is rotatable relative to a body of the device, and wherein the spindle is disposed non-parallel with respect to the device main axis.

67. The tubing expansion device of claim 1, wherein the at least one expansion member is adapted to expand the tubing by solely inducing a hoop stress in the tubing.

68. A tubing expansion device, comprising:

at least one expansion member adapted to expand a tubing by inducing a hoop stress in the tubing; and at least one further expansion member adapted to expand the tubing by inducing a compressive yield of the tubing, wherein one of said at least one expansion member and said at least one further expansion member is adapted to expand the tubing to a first diameter and the other of said at least one expansion member and said at least one further expansion member is adapted to further expand the tubing to a larger second diameter, wherein the compressive yield inducing expansion member is provided as part of a compressive yield inducing expansion member module releasably coupled to a body of the device as a unit, wherein the compressive yield inducing expansion member is rotatably mounted on a spindle, wherein the spindle is cantilevered and extends from a body of the device.

69. A tubing expansion device comprising:

at least one expansion member adapted to expand a tubing by inducing a hoop stress in the tubing, wherein the hoop stress inducing expansion member comprises an expansion cone; and at least one further expansion member adapted to expand the tubing by inducing a compressive yield of the tubing, wherein one of said at least one expansion member and said at least one further expansion member is adapted to expand the tubing to a first diameter and the other of said at least one expansion member and said at least one further expansion member is adapted to further expand the tubing to a larger second diameter, wherein the device is arranged such that expansion of the tubing to a desired final diameter is carried out using the hoop stress inducing expansion member.

70. The tubing expansion device of claim 69, wherein the expansion cone engages an inner wall of the tubular around a majority of the inner diameter in order to expand the tubing.

* * * * *

UNITED STATES PATENT AND TRADEMARK OFFICE

CERTIFICATE OF CORRECTION

PATENT NO. : 8,746,028 B2
APPLICATION NO. : 10/809042
DATED : June 10, 2014
INVENTOR(S) : Duggan et al.

It is certified that error appears in the above-identified patent and that said Letters Patent is hereby corrected as shown below:

On the Title Page, References Cited Item (56):

Please delete "2,683,073 A 12/1953 Bieber et al." and insert --2,663,073 A 12/1953 Bieber et al.-- therefor;

In the Claims:

Column 23, Claim 37, Line 62, please delete "hoops" and insert --hoop-- therefor.

Signed and Sealed this
Twenty-third Day of September, 2014

Michelle K. Lee

Michelle K. Lee
*Deputy Director of the United States Patent and Trademark Office*